US010933296B2

(12) United States Patent
Wilson

(10) Patent No.: US 10,933,296 B2
(45) Date of Patent: Mar. 2, 2021

(54) AUTOMATICALLY ADAPTIVE SKI

(71) Applicant: Anton F. Wilson, Croton on Hudson, NY (US)

(72) Inventor: Anton F. Wilson, Croton on Hudson, NY (US)

( * ) Notice: Subject to any disclaimer, the term of this patent is extended or adjusted under 35 U.S.C. 154(b) by 0 days.

(21) Appl. No.: 15/957,503

(22) Filed: Apr. 19, 2018

(65) Prior Publication Data

US 2018/0369681 A1 Dec. 27, 2018

Related U.S. Application Data

(63) Continuation of application No. 15/187,453, filed on Jun. 20, 2016, now Pat. No. 9,950,242.
(Continued)

(51) Int. Cl.

| | |
|---|---|
| ***A63C 5/07*** | (2006.01) |
| ***A63C 5/04*** | (2006.01) |
| ***A63C 5/075*** | (2006.01) |
| ***A63C 9/00*** | (2012.01) |
| ***A63C 5/048*** | (2006.01) |
| ***A63C 5/052*** | (2006.01) |

(52) U.S. Cl.
CPC ..... *A63C 5/07* (2013.01); *A63C 5/0405* (2013.01); *A63C 5/048* (2013.01); *A63C 5/052* (2013.01); *A63C 5/075* (2013.01); *A63C 9/003* (2013.01); *A63C 9/007* (2013.01)

(58) Field of Classification Search
CPC ..... A63C 5/07; A63C 5/0405; A63C 5/048; A63C 5/052; A63C 5/075; A63C 9/003; A63C 9/007
See application file for complete search history.

(56) References Cited

U.S. PATENT DOCUMENTS

| | | | |
|---|---|---|---|
| 382,254 | A | 5/1888 | Conradson |
| 1,101,631 | A | 6/1914 | Jacques |

(Continued)

FOREIGN PATENT DOCUMENTS

| | | |
|---|---|---|
| CA | 2409954 | 5/2004 |
| CH | 678278 | 8/1991 |

(Continued)

OTHER PUBLICATIONS

Anand et al., Engineering Mechanics: Statics, Allyn and Bacon, Inc., pp. 76-77, 1984.

(Continued)

*Primary Examiner* — Erez Gurari
(74) *Attorney, Agent, or Firm* — Gregory A. Walters; Walters IP Law

(57) ABSTRACT

A ski for use on ice or snow is disclosed. The ski includes a ski body having a tip portion, a tail portion, and a longitudinal running length extending between the tip portion and the tail portion and a substantially flat bottom surface for sliding on snow or ice. The ski also includes a suspension system comprised of a substantially rigid support structure secured to the longitudinally central region of the said ski body at two attachment locations separated by a distance of at least 5 inches along the longitudinal axis of the ski body, and at least one resilient element configured to exert an opposing force between the support structure and the ski body in the area between the two attachment locations.

34 Claims, 14 Drawing Sheets

Related U.S. Application Data

(60) Provisional application No. 62/182,252, filed on Jun. 19, 2015.

(56) References Cited

U.S. PATENT DOCUMENTS 3,260,531 A * 7/1966 Heuvel ..... A63C 5/00 280/602
3,260,532 A 7/1966 Heuvel
3,300,226 A 1/1967 Reed, Jr.
3,797,839 A 3/1974 Smolka et al.
3,863,915 A 2/1975 Pifer
4,067,593 A 1/1978 Earl
4,147,378 A 4/1979 Reich
4,221,400 A 9/1980 Powers
4,300,786 A 11/1981 Alley
4,509,227 A 4/1985 Keane
4,555,651 A 11/1985 Melocik et al.
4,565,386 A 1/1986 Crainrich
4,592,567 A 6/1986 Sartor
4,647,061 A 3/1987 Girard
4,696,487 A 9/1987 Girard
4,738,456 A 4/1988 Creason
4,804,200 A 2/1989 Kuchler
4,848,781 A 7/1989 Dykema et al.
4,895,388 A 1/1990 Richmond
5,046,751 A 9/1991 Scherubl
5,125,680 A 6/1992 Bejean et al.
5,135,250 A 8/1992 Abondance
5,158,318 A 10/1992 Dittmar
5,251,923 A 10/1993 Stepanek
5,269,555 A 12/1993 Ruffinengo
5,284,357 A 2/1994 Tinkler
5,294,144 A 3/1994 Stepanek et al.
5,301,976 A 4/1994 Stepanek et al.
5,320,377 A 6/1994 Ruffinengo
5,326,126 A 7/1994 Ruffinengo
5,332,252 A 7/1994 Le Masson et al.
5,342,077 A 8/1994 Abondance
5,393,086 A 2/1995 Le Masson et al.
5,395,132 A 3/1995 Abondance et al.
5,421,602 A 6/1995 Stepanek et al.
5,435,588 A 7/1995 Commier
5,437,468 A 8/1995 Schenner
5,441,296 A 8/1995 Phelipon et al.
5,464,242 A 11/1995 Commier
5,465,994 A 11/1995 Commier et al.
5,470,094 A 11/1995 Commier et al.
5,551,720 A 9/1996 Ruffinengo
5,597,170 A * 1/1997 Le Masson ..... A63C 5/07 280/602
5,671,939 A 9/1997 Pineau
5,704,628 A 1/1998 Boehm et al.
5,758,894 A 6/1998 Maggiolo
5,775,716 A * 7/1998 Harsanyi ..... A63C 5/07 280/602
5,803,479 A 9/1998 Meyer
5,806,875 A 9/1998 Bonvallet
5,820,154 A 10/1998 Howe
5,829,776 A 11/1998 Deville
5,845,923 A 12/1998 Zanco
5,915,716 A 6/1999 Artus
5,915,719 A 6/1999 Bauvois
5,924,717 A 7/1999 Jarisch
5,927,743 A 7/1999 Mantel
5,954,356 A 9/1999 Busby et al.
5,984,344 A 11/1999 Harsanyi et al.
6,086,101 A * 7/2000 Cormican ..... A63C 5/07 180/182
6,131,939 A 10/2000 Fels
6,158,747 A * 12/2000 Magnani ..... A63C 5/075 280/11.14
6,182,998 B1 * 2/2001 Huyghe ..... A63C 5/075 280/602
6,220,631 B1 4/2001 Pritchard et al.
6,270,108 B1 * 8/2001 Phelipon ..... A63C 5/075 280/602
6,619,688 B2 9/2003 Billon et al.
6,659,493 B1 12/2003 Trnka
6,679,513 B1 1/2004 Emig
6,679,514 B2 1/2004 Luitz
6,729,640 B1 5/2004 Sedlmair
6,779,810 B1 8/2004 Mangold
6,789,806 B2 9/2004 Santa Cruz et al.
6,834,881 B2 12/2004 Mash
6,857,653 B2 2/2005 Wilson
6,883,823 B2 4/2005 Riepler et al.
7,014,206 B2 3/2006 Donze
7,021,647 B2 4/2006 Restani
7,111,864 B2 9/2006 Molg
7,134,680 B2 11/2006 Emig et al.
7,281,729 B1 10/2007 Wilson
7,296,818 B2 11/2007 Krumbeck et al.
7,341,271 B2 3/2008 Bünter
7,487,975 B2 2/2009 Pryputniewicz
7,607,679 B2 10/2009 Wilson
7,690,674 B2 4/2010 Trimble
7,708,302 B2 * 5/2010 Wilson ..... A63C 5/03 280/11.14
7,793,969 B2 9/2010 Wilson
7,798,514 B2 9/2010 Canaday et al.
7,823,892 B2 11/2010 Olson et al.
7,837,217 B2 11/2010 Avgustin
8,172,250 B2 5/2012 Krafft
8,297,640 B2 10/2012 Ametsbichler
8,371,604 B1 2/2013 Soucy
8,764,044 B2 7/2014 Bergendahl
8,783,707 B2 7/2014 Reguis
8,794,658 B2 8/2014 Wilson
9,044,664 B1 6/2015 Canaday
9,108,101 B2 8/2015 Gilson
9,120,003 B2 9/2015 Gilson
2002/0024187 A1 * 2/2002 Gyr ..... A43B 13/141 280/14.22
2003/0141700 A1 7/2003 Turner et al.
2003/0234513 A1 12/2003 Zanco
2004/0046362 A1 3/2004 Restani
2004/0084879 A1 * 5/2004 Wilson ..... A63C 5/0485 280/608
2004/0135327 A1 * 7/2004 Bunter ..... A63C 5/04 280/11.14
2004/0145152 A1 7/2004 Santa Cruz et al.
2004/0178606 A1 9/2004 Asley
2004/0232656 A1 11/2004 Gyr
2004/0232657 A1 11/2004 Lee
2004/0262885 A1 12/2004 Wilson
2005/0073131 A1 4/2005 Krumbeck et al.
2005/0104328 A1 5/2005 Emig et al.
2005/0151350 A1 * 7/2005 Watson ..... A63C 5/07 280/602
2005/0206128 A1 9/2005 Gignoux
2005/0212258 A1 9/2005 Enders
2006/0012150 A1 1/2006 Zanco
2006/0119055 A1 6/2006 Heidlebaugh
2006/0151973 A1 7/2006 Quaggiotti
2006/0186618 A1 8/2006 Bregeon
2006/0226613 A1 * 10/2006 Wilson ..... A63C 5/03 280/14.22
2006/0290104 A1 12/2006 Restani
2008/0106069 A1 5/2008 Holzer
2008/0185815 A1 8/2008 Riepler
2008/0185816 A1 8/2008 Riepler
2008/0272575 A1 11/2008 Olson
2008/0290621 A1 11/2008 Vailli
2009/0071019 A1 * 3/2009 Pupko ..... A43B 5/0439 33/6
2009/0189370 A1 7/2009 Krafft
2009/0206564 A1 8/2009 Lin
2009/0267324 A1 10/2009 Macek
2010/0052291 A1 3/2010 Ametsbichler
2010/0148472 A1 6/2010 Phelipon
2010/0171288 A1 7/2010 Nicosia
2010/0176575 A1 7/2010 Smith et al.

(56) References Cited

U.S. PATENT DOCUMENTS

| | | | | |
|---|---|---|---|---|
| 2010/0194076 | A1 | 8/2010 | Wilson | |
| 2010/0237588 | A1 | 9/2010 | Krause | |
| 2010/0320731 | A1 | 12/2010 | Wilson | |
| 2010/0327560 | A1 | 12/2010 | Silva | |
| 2011/0001304 | A1 | 1/2011 | Dutaut | |
| 2011/0001305 | A1 | 1/2011 | Huber | |
| 2011/0025021 | A1 | 2/2011 | Sitar | |
| 2011/0121542 | A1 | 5/2011 | Krafft | |
| 2011/0233900 | A1* | 9/2011 | Huard | A63C 5/0405 280/602 |
| 2012/0032417 | A1 | 2/2012 | Mantegazza | |
| 2013/0106068 | A1* | 5/2013 | Franko | A63C 5/02 280/11.15 |
| 2014/0050521 | A1* | 2/2014 | Pearce | A63C 9/003 403/322.4 |
| 2014/0312597 | A1 | 10/2014 | Wilson | |
| 2016/0008697 | A1* | 1/2016 | Puget | A63C 5/075 280/602 |
| 2017/0043238 | A1* | 2/2017 | Wilson | A63C 5/048 |
| 2018/0221744 | A1* | 8/2018 | Ball | A63C 9/007 |
| 2019/0022513 | A1* | 1/2019 | Avgustin | A63C 9/02 |

FOREIGN PATENT DOCUMENTS

| | | |
|---|---|---|
| DE | 19836515 | 2/1999 |
| EP | 0230989 | 8/1987 |
| EP | 0330620 | 8/1989 |
| EP | 0345217 | 12/1989 |
| FR | 1118857 | 6/1956 |
| JP | H04292181 | 10/1992 |
| JP | 07088219 | 4/1995 |
| JP | 07313654 | 12/1995 |
| JP | 2001231906 | 8/2001 |
| WO | WO1995033536 | 12/1995 |
| WO | WO2000071213 | 11/2000 |
| WO | WO2004110573 | 12/2004 |
| WO | WO2006057958 | 6/2006 |
| WO | WO2006088908 | 8/2006 |
| WO | WO2013097948 | 7/2013 |

OTHER PUBLICATIONS

European Office Action for Application No. 16175358.7, dated Dec. 23, 2016, 6 pages.

European Search Report for Application No. 16175358.7, dated Dec. 9, 2016, 5 pages.

European Search Report for Application No. EP05849050.9, dated Oct. 5, 2010, 5 pages.

European Search Report for Application No. EP06720755.5, dated Dec. 17, 2010, 5 pages.

European Search Report for Application No. EP07716865.6, dated Sep. 10, 2012, 6 pages.

International Search Report and Written Opinion for PCT/US2005/042129, dated May 21, 2007, 6 pages.

International Search Report and Written Opinion for PCT/US2006/005243, dated Sep. 13, 2007, 6 pages.

International Search Report and Written Opinion for PCT/US2007/001601, dated Sep. 9, 2008, 6 pages.

International Search Report for PCT/NO2000/000165, dated Sep. 6, 2000, 2 pages.

* cited by examiner

AUTOMATICALLY ADAPTIVE SKI

CROSS-REFERENCE TO RELATED APPLICATION

This application is a continuation (and claims the benefit of priority under 35 U.S.C. § 120) of U.S. application Ser. No. 15/187,453, filed Jun. 20, 2016, and titled "AUTOMATICALLY ADAPTIVE SKI," which claims the benefit of U.S. Provisional Application No. 62/182,252, filed Jun. 19, 2015, both of which are expressly incorporated herein by reference in their entirety.

BACKGROUND

The sport of alpine skiing is practiced in a wide variety of snow conditions from soft, deep, "bottomless" powder to hard-packed snow and solid ice. This wide range of snow conditions actually encompasses two totally distinct states of the snow: fluid and solid. Each of these two distinct states actually mandates totally different ski equipment.

Devices for moving in a fluid medium must be designed to be buoyant, like a boat, or create lift, like an airplane wing. Conversely, devices designed for a firm surface typically employ means to solidly engage the surface while comprising means to conform to surface irregularities like a military tank tread.

Clearly a military tank and a boat are two distinct devices with little in common, yet the vast majority of recreational alpine skiers attempt to address the distinct solid and fluid states of the snow with a single device—the conventional alpine ski. In reality, there should be two discrete devices, each designed for the specific condition.

Avid, expert skiers are aware of this dichotomy and indeed often employ very different skis for each of these conditions. Firm and hard-packed conditions require fairly stiff skis with significant camber that provide tip and tail pressure to facilitate carving. While this ski design provides excellent performance on firm snow, it is totally inappropriate in powder conditions, as the stiff, cambered tip will dive into the snow instead of floating on top of it.

Conversely, soft snow and powder conditions require a soft flexing ski that incorporates a raised or "rockered" tip similar to the prow of a boat. This tip design keeps the ski from diving into the snow while the soft flex allows the ski to bend and thus evenly pressure the entire length of the ski against the snow for stability and control.

There have been attempts to create a single ski that can reasonably be adapted to the two distinct snow conditions. One design basically starts with a firm-snow carving type ski and adds a mechanical "switch" that can be manually activated to raise the tip of the ski into a rocker configuration. In reality, this is very inconvenient as the skier must stop and take the skis off or reach down in order to switch both skis into the opposite mode every time a transition from firm to soft is encountered and vice-versa.

Another approach that has been tried basically comprises a relatively short carving ski or snowblade with conventional camber but with an extended tip and tail region that is "rockered". This compromised design only uses the central cambered region of the ski when on a firm surface as the raised tip and tail are in the air, off the snow. Thus on a groomed slope this ski has the undesirable swing weight of a long ski with the instability of an inordinately short ski. Additionally, this design is also a compromise in the soft powder, as the stiff center section does not provide a uniform flex pattern.

The ideal and uncompromised solution would be a ski that responds to the snow condition, transitioning automatically to a soft rocker configuration in powder and a firm, cambered carving configuration on compacted groomed snow.

SUMMARY

This specification describes novel suspension systems and ski designs that in combination have dynamic characteristics that are dramatically different from the conventional skis described above. The automatically adaptive ski described herein responds to a range of conditions defined by the snow and terrain, automatically and instantly transforming the dynamic characteristics of the ski to match those mandated by the currently encountered state of the snow and terrain.

Unlike the previous attempts at a ski that can cope with both powder and firm snow conditions, the implementations of the ski described herein do not require manual switching nor do they exhibit the other compromises as described above. The skier can continuously transition from soft powder to hard-packed groomed runs and back again with confidence and control as the ski will automatically provide the appropriate dynamic characteristics for each condition.

Specifically, when on a firm or hard-packed snow surface, the adaptive ski described herein will concentrate a majority of the skier's weight in the very central area of the ski directly under the ski boot, creating very high edge pressure to penetrate and lock onto the hard snow. Concurrently, the pressure of the skier's weight against the hard snow causes the suspension system to bend the tip and tail downward onto the snow to maintain the requisite consistent tip and tail pressure necessary for stability and control when carving or drifting on firm snow.

Conversely, when very soft snow or powder is encountered, there is no hard snow under the ski to compress the central resilient elements, which then expand. This in turn forces the suspension system to bend the tip and tail upward creating the ideal "rocker" configuration conducive to powder skiing.

This unique ski comprises many construction and design parameters that are diametrically opposite those of conventional skis.

While the suspension systems described herein can be coupled to a wide variety of ski or runner designs, a preferred implementation of this adaptive ski comprises a runner or ski element that exhibits a unique longitudinal flex pattern.

All skis employ a cantilever design whereby the height or thickness of the ski is greatest in the central section under the boot, which creates the maximum stiffness required to resist the large bending moments that emanate from the distant tip and tail. The thickness of the conventional ski then continually diminishes from the thick central section toward the tip and tail in order to provide the appropriate flexibility for the tip and tail to bend, which is necessary in varying degrees when carving a turn or floating in powder. In summary, the conventional ski exhibits a single region of maximum flexural modulus in the approximate longitudinal center or boot binding location, and the flexural modulus continuously diminishes both longitudinally forward and rearward toward the tip and tail respectively.

Conversely to this configuration, another implementation of the adaptive ski described herein features a ski body (runner) that does not exhibit a single area of maximum bending stiffness or flexural modulus in the central most region. Instead, the runner exhibits maximum stiffness and flexural modulus in two areas, one located longitudinally forward of the central area of the ski, and the other located longitudinally behind the central area of the ski. Longitudinally between these two areas, the runner exhibits a stiffness and flexural modulus that is less than that of the said maximum stiff areas to either side. This reduced stiffness in the center of the runner can be achieved by a thinner cross-sectional height or a less stiff construction design or by utilizing materials with a lower flexural modulus. This reduced flexural modulus in the center section of the runner can also be achieved by inclusion of one or more hinges between the said two areas of maximum stiffness, the hinges being longitudinally narrow areas of very low flexural strength achieved by a thinner cross-sectional height or a less stiff construction design or by utilizing materials with a lower flexural modulus in the hinge area. Additionally, the flex or stiffness of this runner typically diminishes toward the tip from the forward maximum stiffness area, and likewise toward the tail from rearward maximum stiffness area.

In another implementation, brackets are provided at the aforementioned two areas of maximum stiffness to which the support structure of a suspension can be attached to the runner. This support structure and suspension system can also be attached to skis and runners with other longitudinal flex patterns in which case the brackets are attached on the runner/ski at longitudinally central locations separated longitudinally by preferably at least 5 inches. Additionally, stiffening elements can be attached to the ski body that will stiffen the ski body at the locations of the brackets such that the resulting longitudinal flexural modulus of the ski with such elements attached measured at the bracket attachment locations will be greater than the longitudinal flexural modulus of the ski body measured in the region between the two attachment locations. Additionally, the stiffening elements may be integral with the attachment brackets.

The attachment method generally precludes roll and yaw motion between the attached suspension system support structure and the runner body, but typically allows limited relative motion between the attached suspension system support structure and the runner body in the vertical and horizontal planes as well as around the pitch axis. Such relative motion is typically limited by resilient and/or damping materials in the attachment mechanisms.

The suspension system so attached comprises at least one resilient member, where the resilient member(s) is (are) configured to exert an opposing force between the support structure of the suspension system and the runner body in the area between the two attachment points. Typically, an adjustment mechanism is provided to adjust the magnitude of this opposing force over a wide range from 0 pounds up to 200 pounds or more. Additionally, the suspension system so attached can also comprise one or more damping elements, the damping elements(s) configured to damp motion between the support structure of the suspension system and the runner body.

Additionally, the attached suspension system can comprise one or more resilient or solid member(s) disposed longitudinally forward or behind the area between the two attachment points, the resilient member(s) configured to exert an opposing force between the support structure of the suspension system and the runner body. Typically, the magnitude of this opposing force can be adjusted over a wide range including precluding the force altogether or applying said force only after the runner body has been bent or deflected to a specific extent.

The suspension system may also include one or more spring-like compressible element(s), e.g., a leaf spring or bow spring, attached between the suspension system support structure, or elements within the support structure, and a front and/or rear longitudinal third of the runner body. This configuration can provide the skis with a significant preload force on the tip and tail while the runner body remains flexible with a relatively low spring rate. With the runner flat on the snow, this high compliance/low spring rate preload already applies a portion of the weight of the skier to the tip and tail of the ski. As a result, as the skier eases into a subtle edge angle, the tip and tail can immediately engage the snow with stability. The skis do not have to be bent up to a threshold arc to turn, and thus the skier can generally steer from wide left turns to wide right turns smoothly with ease. The preload forces also provide significantly greater fore and aft stability for the recreational skier. A beginner and intermediate skier generally has a major problem maintaining balance and stability. A recreational skier typically leans backwards when imbalanced or frightened, which lifts the tip of the ski off the snow causing further loss of turning control which may result in the inevitable fall. It is this loss of control and falling that is the most frequent reason given by those who have given up the sport. The suspension system herein, with the spring-like compressible elements attached between the suspension system and the front and rear longitudinal third of the ski body, precludes this loss of control and potential for falling by creating a long travel, independently pressured tip and tail such that the tip and tail will be kept constantly pressured and curved onto the snow even when the skier becomes significantly imbalanced and/or leans backwards.

Additionally, the magnitude of such preload forces on the tip and tail as well as the magnitude of the camber or "rocker" of the tip and tail can be adjusted. Moreover, this feature that controls the magnitude of the camber or "rocker" of the tip and tail can be coupled to the central area of the ski between the two attachment points in a manner such that the expansion of the central resilient member(s) causes the tip and/or tail to reduce camber (increase "rocker") and likewise compression of the central resilient member(s) causes the tip and or tail to increase camber (reduce "rocker").

The runner body can be manufactured with integral camber or integral "rocker" (reverse camber) or horizontally flat with neither camber nor "rocker". One implementation features a runner body that exhibits significant camber and the attached suspension system comprises elements to restrain or diminish the natural free camber of the runner body in order to create an immediate preload on the tip and tail. The runner body so restrained can exhibit camber or "rocker" or be horizontally flat with neither camber nor "rocker". The camber restraining mechanism may further include an adjustment device to allow the degree to which the camber is restrained to be adjusted. Moreover, this restraining feature that controls the camber or "rocker" of the tip and tail can be coupled to the central area of the ski between the two attachment points in a manner such that the expansion of the central resilient member(s) causes the tip and or tail to reduce camber (increase "rocker") and likewise compression of the central resilient member(s) causes the tip and or tail to increase camber (reduce "rocker").

In addition to providing the aforementioned ability to instantly transform from a cambered groomed terrain ski to a "rockered" powder ski and vice-versa based on the respective snow conditions, the adaptive ski also comprises a shock absorbing function in firm snow conditions. The resilient and/or damping member(s) configured to exert an opposing force between the support structure of the suspension system and the runner body in the area between the two attachment points, effectively mitigate impacts that would otherwise be transmitted directly to the skier. This effect is further enhanced when the suspension system is coupled to the runner body that comprises the central area(s) of reduced flexural modulus.

When the ski is unweighted by the skier in the course of skiing, the pre-loaded resilient member(s), configured to exert an opposing force between the support structure of the suspension system and the runner body in the area between the two attachment points, expand and force the central section of the runner body to bend downward away from the suspension support structure such that the runner body is now convex relative to the snow surface, and therefore this central section of the runner body will be the first to contact the snow when the ski is again weighted. Thus, upon weighting the ski, the convex protruding central section of the runner must first be bent to a flat configuration by compressing the resilient and/or damping member(s) before the runner body at the attachment points will contact the firm snow. Since the attachment points are the only direct connection to the skier's boot, the resilient and damping member(s) will absorb and mitigate much of any such impacts before they are transmitted to the ski boot by the attachment points. Furthermore, the attachment elements can provide additional resilient and damping forces in the vertical plane that will further absorb and mitigate impacts.

The design of the adaptive ski described herein also enables the skier to more easily transition from a pure carve to a smooth drift/skid and vice-versa. When on hard snow, the preloaded resilient elements in the center of the ski creates a high PSI (pounds per square inch) pressure on the runner edge immediately under the skier's boot, thus providing great penetration in the hard snow to initiate and maintain a pure carve. However, when the ski is flattened to initiate a skid/drift, this concentrated high pressure in the center of the ski creates a compact pivot platform that makes it easy to swivel the ski into a drift. Simultaneously, the high compliance preloaded spring-like compressible elements attached between the suspension system and the tip and tail areas of the runner body keeps the tip and tail in continuous contact with the snow. Together, these two features provide the skier with an extraordinary level of control while drifting.

According to an innovative aspect of the subject matter described in this application, a ski for use on ice or snow includes a ski body comprising a tip portion, a tail portion, and a longitudinal running length extending between the tip portion and the tail portion and a substantially flat bottom surface for sliding on snow or ice. The ski also includes a suspension system comprised of a substantially rigid support structure secured to the longitudinally central region of the said ski body at two attachment locations separated by a distance of at least 5 inches along the longitudinal axis of the ski body, and at least one resilient element configured to exert an opposing force between the support structure and the ski body in the area between the two attachment locations.

The ski may include one or more of the following optional features. For example, the opposing force exerted by the resilient element may be concentrated in an area centrally located between the two attachment points. Expansion of the resilient element that is configured to exert an opposing force between the support structure and the ski body between the two attachment locations may cause the tip and/or tail of the ski body to bend upward, decreasing camber and increasing rocker. Compression of the resilient element that is configured to exert an opposing force between the support structure and the ski body between the two attachment locations may cause the tip and/or tail of the ski body to bend downward, increasing camber.

The resilient element may be selected from the group consisting of coil springs, torsion springs, torsion bars, leaf springs bow springs, pneumatic springs, and elastomers. The resilient element may include a damping element. The opposing force between the support structure and the ski body exerted by the resilient element may be adjustable. The ski may further include elements that increase the longitudinal flexural modulus of the ski body at the locations where the support structure is attached to the ski body such that the resulting longitudinal flexural modulus of the ski at the locations is greater than the longitudinal flexural modulus of the ski body in the region between the attachment locations.

According to another innovative aspect of the subject matter described in this application, a ski for use on ice or snow includes a ski body comprising a tip portion, a tail portion, and a longitudinal running length extending between the tip portion and the tail portion and a substantially flat bottom surface for sliding on snow or ice. The ski also includes a longitudinal flexural modulus that varies from the tip portion to the tail portion such that the longitudinal flexural modulus in a central longitudinal region of the ski is less than the longitudinal flexural modulus both longitudinally fore and aft of the central longitudinal region of the ski body.

The ski may include one or more of the following optional features. For example, the ski body may include one or more grooves cut across a top surface of the ski. The one or more grooves may create a region of flexural modulus in the central longitudinal region of the ski that is less than the longitudinal flexural modulus both longitudinally fore and aft of the central longitudinal region of the ski body.

The ski may include two or more longitudinal regions of low flexural modulus located in the central longitudinal region of the ski body, and longitudinal regions both fore and aft of the central longitudinal region of the ski that exhibit greater longitudinal flexural modulus than the regions of low flexural modulus.

The ski may further include a suspension system having a substantially rigid support structure attached to the ski body at two locations, one location longitudinally forward of the central region of low flexural modulus and the second location longitudinally behind the central region of low flexural modulus.

The ski may further include at least one resilient element configured to exert an opposing force between the support structure and the ski body in an area centrally located between the two attachment locations. Alternatively, or additionally, the ski may include at least one resilient element secured between the support structure and the ski body, where the resilient element is positioned orthogonal to the support structure and the ski body, and configured to exert an opposing point force between the support structure and the ski body concentrated in a central area between the two attachment locations.

The ski may include a first region of lower flexural modulus and a second region of lower flexural modulus, and a contact region disposed between the first and second regions of lower flexural modulus, wherein the resilient element engages the contact region to exert the opposing force between the support structure and the ski body. The first and second regions of lower flexural modulus may include one or more grooves cut across a top surface of the ski. The resilient element may be two coil springs. Alternatively, the resilient element may be a bow spring.

The resilient element may be selected from the group consisting of coil springs, torsion springs, torsion bars, leaf springs, bow springs, pneumatic springs, and elastomers. The resilient element may include a damping element.

Expansion of the resilient element that is configured to exert an opposing force between the support structure and the ski body between the two attachment locations may cause the tip and tail of the ski body to bend upward, increasing rocker and decreasing camber. Compression of the resilient element that is configured to exert an opposing force between the support structure and the ski body between the two attachment locations may cause the tip and tail of the ski body to bend downward, increasing camber. The opposing force between the support structure and the ski body exerted by the resilient element may be adjustable.

The ski may further include two mounting brackets that couple the support structure to the ski body and at least one of the mounting brackets may allow longitudinal movement between the ski body and the support structure. The two mounting brackets may each include elements configured to substantially preclude yaw and roll movement between the support structure and the ski body while allowing elastic movement between the support structure and the ski body in the vertical and longitudinal directions as well as around the pitch axis.

The ski may further include one or more compressible or rigid elements positioned between the support structure and the ski body either forward of or behind the region between the two attachment points to the ski body, where the compressible or rigid elements may be configured so that further upward deflection of the ski body beyond a predetermined degree of deflection will cause the spring rate of the ski body to be greater than that exhibited prior to being deflected to the predetermined degree of deflection. The predetermined degree of deflection of the ski body may be adjustable. The adjustability of the predetermined degree of deflection of the ski body may be independently adjustable for a front half of the ski body and for a rear half of the ski body.

The ski may include one or more compressible or rigid elements positioned between the support structure and the ski body either forward of or behind the region between the two attachment points to the ski body, where the compressible or rigid elements may be configured so that the deflection spring rate of the ski body is greater than that exhibited without the compressible or rigid elements positioned in the support structure.

The ski may include at least one resilient compressive element, where one end of the resilient compressive element may be coupled to either the front or rear quarter of the running length of the ski body, and the other end may be coupled to the front end or rear end of the support structure respectively, or to elements within the support structure. The one or more of the resilient compressive elements may include damping elements.

The ski may include two resilient compressive elements, where one end of the first compressive element may be coupled to the front quarter of the running length of the ski body and the other end may be coupled to the front of the support structure or to elements within the support structure, and one end of the second resilient compressive element may be coupled to the rear quarter of the running length of the ski body, and the other end may be coupled to the rear end of the support structure or to elements within the support structure.

One or more of the compressive resilient elements may be preloaded so that the resilient element will not compress until the compressive force exceeds a specific threshold, and, prior to said specific threshold force being exceeded, elongation or expansion of the preloaded resilient element is precluded.

Compression of the resilient element that is configured to exert an opposing force between the support structure and the ski body between the two attachment locations, may increase the force that the forward compressive resilient element applies to the forward quarter of the running length of the ski body and/or that the aft compressive resilient element applies to the rear quarter of the running length of the ski body, respectively causing the tip and/or tail of the ski body to bend downward, increasing camber.

Expansion of the compressive resilient element that is configured to exert an opposing force between the support structure and the ski body between the two attachment locations, may decrease the force that the forward compressive resilient element applies to the forward quarter of the running length of the ski body and/or that the aft compressive resilient element applies to the rear quarter of the running length of the ski body, respectively causing the tip and/or tail of the ski body to bend upward, increasing rocker and decreasing camber.

The compressive resilient element may be adjusted to increase or decrease the natural camber or rocker of the ski body. At a predetermined degree of deflection, the ski body may exhibit a spring rate at least 25% less than the maximum spring rate exhibited by the ski prior to the predetermined degree of deflection. The ski body may be constructed with intrinsic positive camber.

The ski may include a first tensile element, where one end of the first tensile element may be coupled to the front quarter of the running length of the ski body, and the other end may be coupled to the front of the support structure or to elements within the support structure, such that the tensile force reduces the natural camber of the ski body.

The ski may include a second tensile element, where one end of the second tensile element may be coupled to the rear quarter of the running length of the ski body, and the other end may be coupled to the rear of the support structure or to elements within the support structure, such that the tensile forces reduce the natural camber of the ski body.

Compression of the resilient element that is configured to exert an opposing force between the support structure and the ski body between the two attachment locations, may decrease the force that the first tensile element applies to the forward quarter of the running length of the ski body causing the tip of the ski body to bend downward, increasing camber. Additionally or alternatively, compression of the resilient element that is configured to exert an opposing force between the support structure and the ski body between the two attachment locations, may decrease the force that the first and second tensile elements apply to the ski body causing the tip and tail of the ski body to bend downward, increasing camber.

Expansion of the resilient element that is configured to exert an opposing force between the support structure and the ski body between the two attachment locations, may increase the force that the first tensile element applies to the forward quarter of the running length of the ski body causing the tip of the ski body to bend upward, increasing rocker and decreasing camber. Additionally or alternatively, expansion of the resilient element that is configured to exert an opposing force between the support structure and the ski body between the two attachment locations, may increase the force that the first and second tensile elements apply to the forward quarter and rear quarter of the running length of the ski body respectively, causing the tip and tail of the ski body to bend upward, increasing rocker and decreasing camber.

Coupling of the resilient element to the forward and/or rear running length of the ski body, may preclude roll movement along the longitudinal axis between the ski body and the support structure, increasing the overall torsional rigidity of the ski.

The details of one or more implementations of the subject matter described in this specification are set forth in the accompanying drawings and the description below. Other features, aspects, and advantages of the subject matter will become apparent from the description, the drawings, and the claims.

DETAILED DESCRIPTION

Figure 1A:
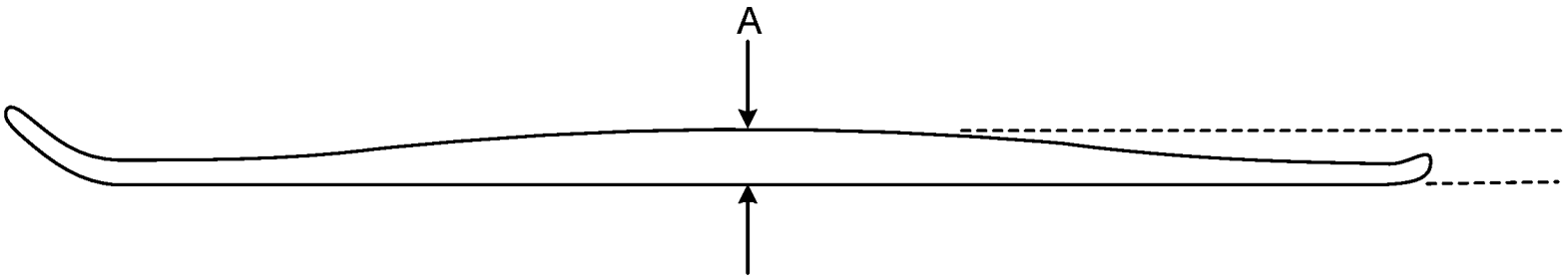
FIG. 1A depicts the longitudinal cross section of a conventional alpine ski.

FIG. 1A depicts the profile of a conventional alpine ski. The ski is thickest in height at the center in order to create the high flexural modulus or stiffness required of the cantilever design. The ski boot is affixed to this central area via a boot binding device (not specifically shown) and thus the relatively long tip and tail sections are cantilevered from this central region, which creates large bending moments that mandate the high flexural modulus in the center. From this single central region of maximum flexural modulus, the profile and flexural modulus continually diminishes toward both tip and tail. Implementations of the adaptive ski described herein do not comprise a ski with this profile or these flexural characteristics. The differences will become apparent from the description that follows.

The runner or ski part of the disclosed implementations of the adaptive ski is not a cantilever design nor does it feature a single region of maximum flexural strength in the longitudinal central section as described above. The preferred implementation of the adaptive ski comprises a runner (ski part) with a low flexural modulus in the longitudinal central region relative to two stiffer sections of the runner toward both the tip and tail.

Figure 1B:
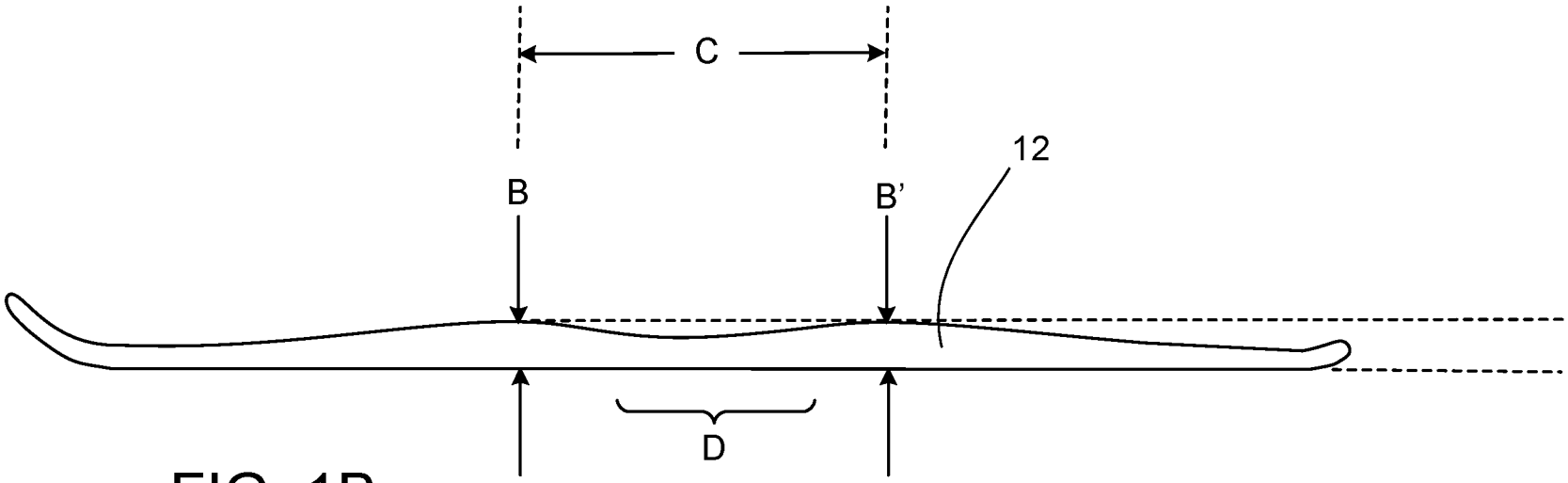
FIG. 1B depicts the longitudinal cross section of the runner element of an implementation of the adaptive ski described herein.

FIG. 1B illustrates the unique profile of one implementation of such a runner 12. In this instance the longitudinal flexural modulus is proportional to the thickness or height of the runner body 12, thus there are two areas of maximum stiffness as indicated by B and B' separated by a distance C. The thinner central section indicated by D exhibits a significantly lower flexural modulus than the sections at B and B', which creates a totally unique dynamic compared to existing alpine skis (e.g., FIG. 1A). When such a runner is coupled to a suspension system described herein, this relatively flexible center section significantly enhances the adaptive characteristics of this invention.

Figure 1C:
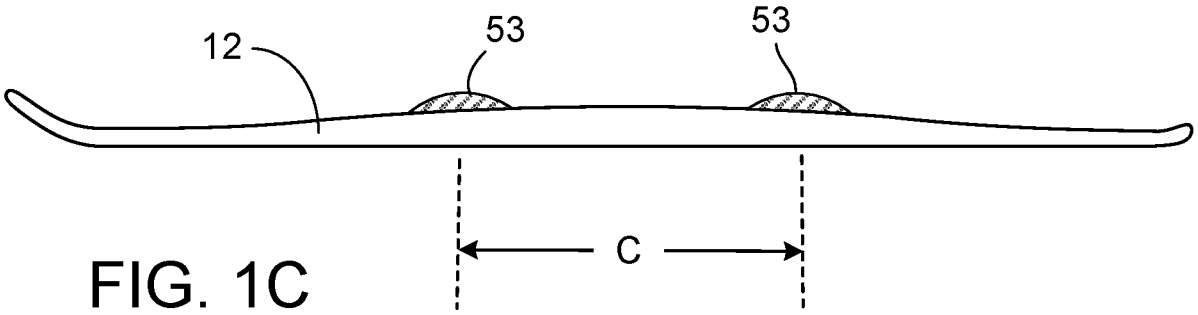
FIG. 1C depicts the longitudinal cross section of the runner element of an implementation of the adaptive ski described herein.
Figure 1D:
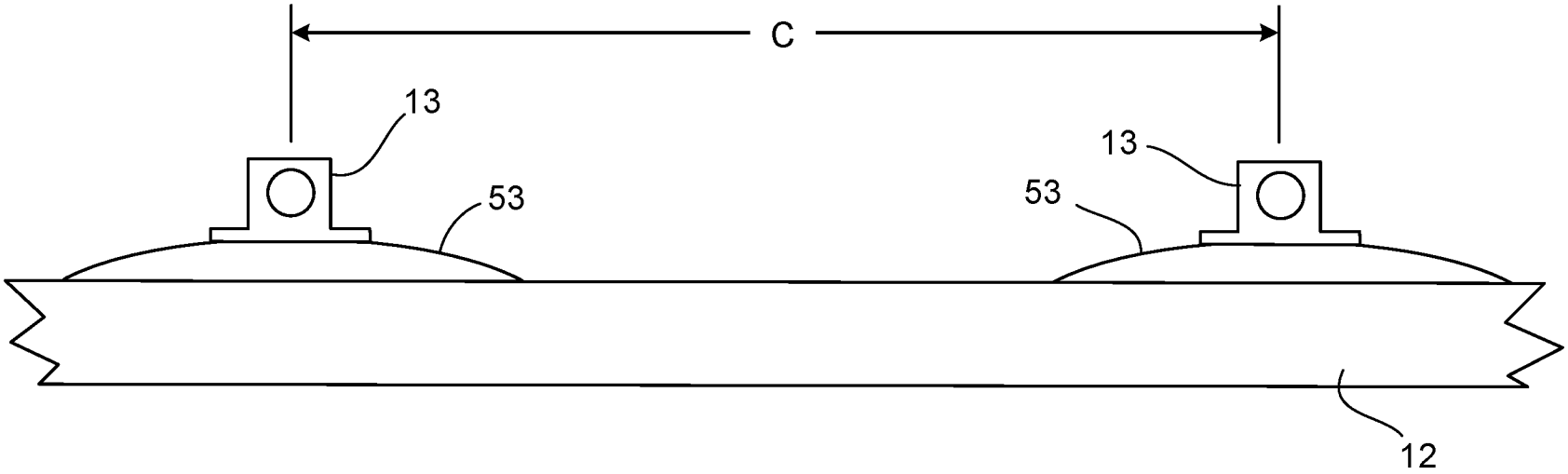
FIG. 1D depicts the central section of an implementation of the runner element of the adaptive ski that is depicted in FIG. 1C.

FIGS. 1C and 1D illustrate an alternate implementation of the runner. While the implementation illustrated in FIG. 1B achieves the low flexural modulus in the central section by thinning the height or thickness of the ski body 12 in that area relative to the areas both fore and aft of it longitudinally, the implementation of the runner in FIG. 1C achieves the lower flexural modulus in the central section by increasing the flexural modulus both fore and aft of it longitudinally with stiffening elements 53. The stiffening elements can be fabricated from a variety of materials exhibiting the characteristics to increase the measured flexural modulus of the ski in the areas where they are located.

These stiffening elements 53 can be created for example by forming an additional layer or thickness of material including fiberglass, polyurethane, and/or other suitable resin material that can be bonded to the ski body in a variety of ways to increase the flexural modulus around the area of the mounting brackets 13. Additionally, these stiffening elements 53 can be integral with the mounting brackets 13 to which a suspension system can be attached. Typically, these stiffening elements 53 and attachment brackets 13 are separated longitudinally by preferably at least 5 inches (12.7 cm) as illustrated by the distance 'C' in FIGS. 1C and 1D.

Figure 2A:
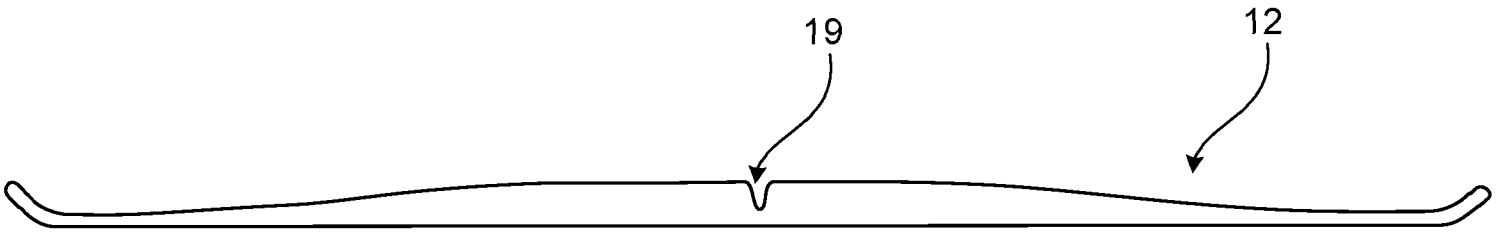
FIGS. 2A & 2B depict alternate implementations of the runner element of the adaptive ski described herein.
Figure 2B:
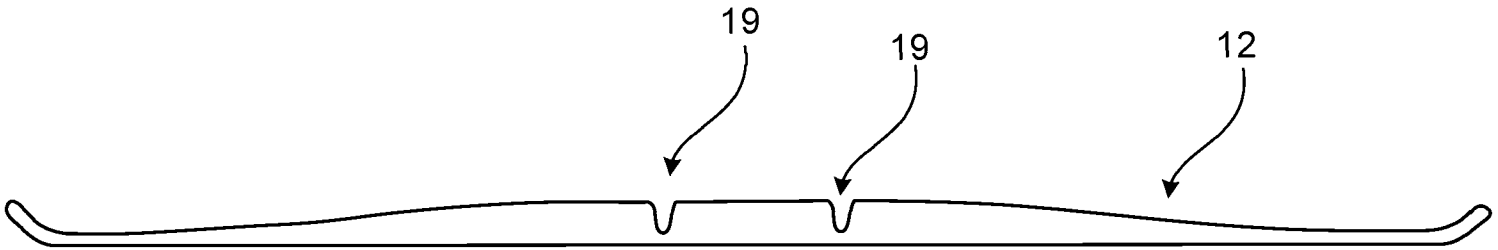

FIGS. 2A and 2B illustrate alternate implementations of the runner. While the implementation illustrated in FIG. 1B achieves the low flexural modulus in the central section by thinning the height or thickness of the ski body 12 in that area, there are many other methods to achieve this same flexibility. The runner profile in FIG. 2A creates the requisite central flexibility with an effective hinge 19 created by thinning the height/thickness of the runner in a longitudinally narrow region. As depicted in FIG. 2B, two or more such flexible hinge points can be utilized. These hinge points can also be created by modifying materials or removing material in other patterns.

Figure 3:
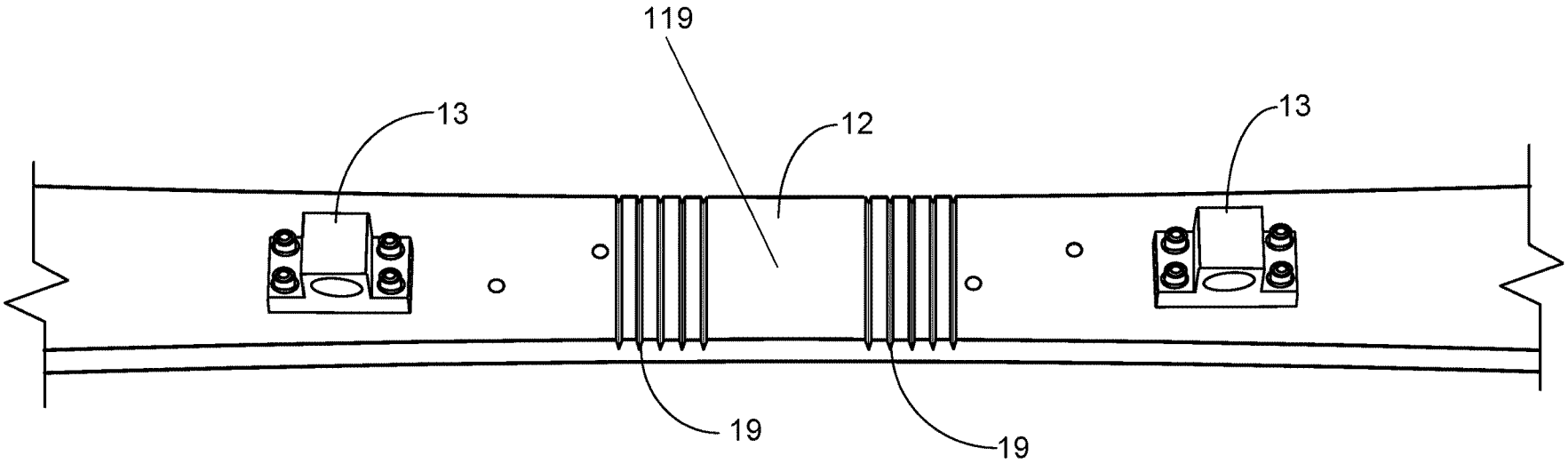
FIG. 3 depicts the central section of an implementation of the runner element of the adaptive ski described herein with flexible hinge points indicated.

FIG. 3 depicts a runner 12 with two central flexible regions 19, each comprising, for example, four hinge points that are created by cutting channels across the top surface of the runner 12. The thickness and/or depth of the channels can be varied to create the desired level of lower flexural modulus in regions 19. Such an effective hinge can also be created by thinning the height/thickness of the runner utilizing any of a multitude of shapes and patterns. The area(s) of central flexibility can also be achieved by utilizing materials with a low flexural modulus in that area relative to materials of higher flexural modulus used in the stiffer sections of the runner. The function of the runner of this implementation of the adaptive ski described herein does not depend on any specific method of construction or design but only that there is a region or regions in the longitudinally central area that exhibit a flexural modulus lower than regions with a greater flexural modulus both fore and aft of said flexible region(s). FIG. 3 also shows a contact region 119 formed and disposed between the two central flexible regions 19. The contact region 119 is designed to have a flexural modulus that is higher than the flexural modulus of the two central flexible regions 19. As will be described in greater detail below, one or more resilient elements, for example one or more coil springs, can engage the contact region 119 to exert an opposing force between the support structure and the runner 12.

Figure 4A:
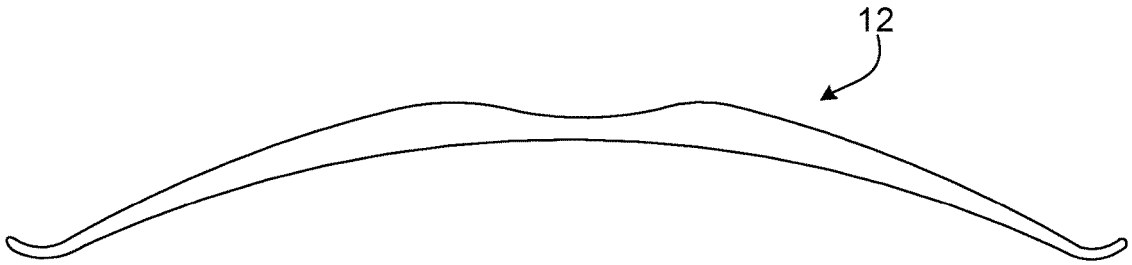
FIG. 4A depicts the longitudinal cross section of the runner element of an implementation of the adaptive ski described herein that has natural camber.
Figure 4B:
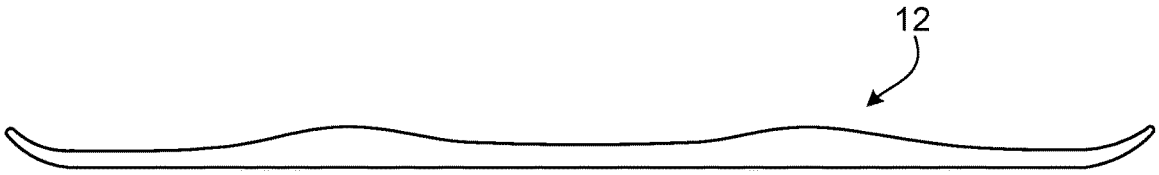
FIG. 4B depicts the longitudinal cross section of the runner element of an implementation of the adaptive ski described herein that is naturally flat, with neither camber nor rocker (negative camber).
Figure 4C:
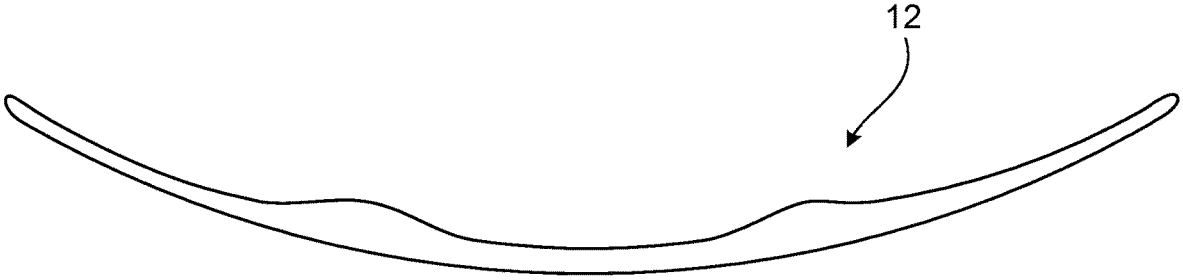
FIG. 4C depicts the longitudinal cross section of the runner element of an implementation of the adaptive ski described herein that has natural rocker (negative camber).

The runner 12 can be manufactured with the bottom essentially flat as depicted in FIG. 4B, or with inherent camber (FIG. 4A), or inherent rocker (FIG. 4C).

Figure 5:
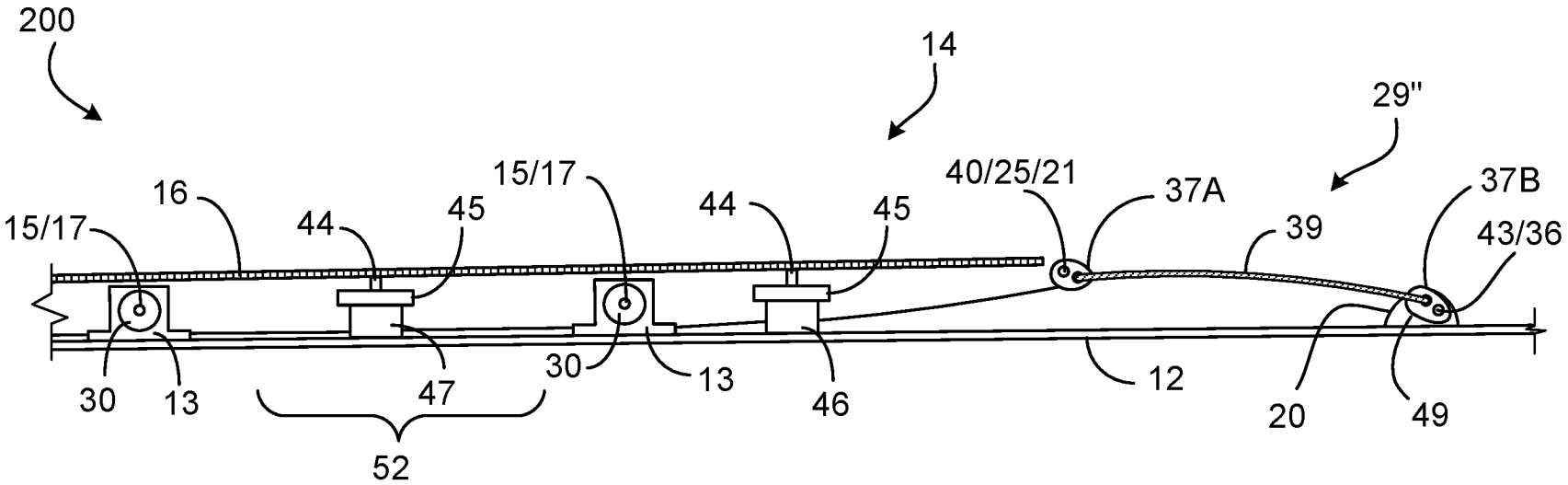
FIG. 5 shows a longitudinal cross section of an implementation of the adaptive ski described herein with key components indicated.

FIG. 5 depicts another implementation of the adaptive ski 200. The runner 12 can exhibit a wide variety of longitudinal flex patterns. A suspension system 14 is attached to the top surface of the runner 12. Two mounting brackets 13 are attached to the runner 12. When the runner 12 comprises the previously described flexible center area 52, one of the mounting brackets 13 is attached forward and one aft of the longitudinally central area 52 of the runner that exhibits the low flexural modulus relative to the flexural modulus of the runner where said mounting brackets 13 are attached.

The mounting brackets 13 may comprise a resilient element 30 that comprises a lateral bore through the center 15. A support structure 16 is attached to brackets 13 by pins 17 that pass through the said bores 15 in the resilient elements 30 as well as corresponding bores in the support structure 16.

With the support structure 16 thusly attached to the ski body 12, the combined structure comprises one or more resilient elements 47 arranged to create an opposing force between the support structure 16 and the ski body 12 in the area between said mounting brackets 13. The resilient element(s) 47 can be selected from the group consisting of coil springs, torsion springs, torsion bars, leaf springs, bow springs, elastomers, and pneumatic springs. Said resilient elements 47 may also exhibit damping characteristics.

The resilient element(s) 47 may include a mechanism to adjust the magnitude of the opposing force that said resilient element 47 exerts between the support structure 16 and the runner body 12. Such mechanism may comprise a threaded stud 44 and a threaded ring 45 allowing said opposing force to be adjusted over a wide range from null to over 200 pounds by rotating the threaded ring 45 on the threaded stud 44 to compress or expand the resilient element 47, effectively raising or lowering the force applied by the resilient element 47.

The support structure 16 may also comprise one or more resilient elements 46 positioned fore and/or aft of the region between the mounting brackets 13. The resilient element(s) 46 can be selected from the group consisting of coil springs, torsion springs, torsion bars, leaf springs, bow springs, elastomers, and pneumatic springs. The resilient elements 46 may also exhibit damping characteristics. The opposing force that said resilient element 46 exerts between the support structure 16 and the runner body 12 may be adjusted by a threaded stud 44 and a threaded ring 45 allowing said opposing force to be adjusted over a wide range by rotating the threaded ring 45 on threaded stud 44 to extend or retract the resilient element 46. The adjustment mechanism may change the vertical position of the resilient element 46 relative to the runner body 12 such that the resilient element will not engage the runner body 12 until the runner body is bent upward or deflected to a predetermined amount such as during skiing.

The suspension system may also include one or more compressible resilient assemblies attached between an end of the support structure, or elements within the support structure, and the tip and/or tail region of the runner body 12. These compressible resilient assemblies can be selected from the group of compressible resilient elements that include coil springs, leaf springs, bow springs, elastomers, and pneumatic springs. The implementation of FIG. 5 depicts bow spring assemblies 29 that are attached to an end of support structure 16 by way of a pin 25 passing through a bore 40 in the mounting boss 37A of the spring assembly 29 as well as a corresponding bore 21 in the ends of the support structure 16. The mounting boss 37B on the opposite end of the spring element 39 is attached to the tip and/or tail of the ski body 12 by way of a pin 36 passing through a bore in the spring mounting boss 37B as well as a bore 43 in the coupling 20, which is attached to the ski body 12. Attaching the torsionally rigid bow spring assembly(s) 29 in this manner, with the hinge pins 25 and 36 being horizontal and parallel to the latitudinal axis of the ski body 12 as well as perpendicular to the longitudinal axis of the ski body 12, results in the bow spring assembly(s) 29 also contributing significantly to the overall torsional rigidity of the adaptive ski, which greatly enhances responsiveness and control for the skier. Spring mounting boss 37B also comprises a screw 49 that is an adjustable stop for the angular motion of the spring assembly 29 relative to the ski body 12, thus affecting the magnitude of camber and rocker, as well as the preload force on the tip and/or tail. This high compliance/low spring rate preload force functionally improves stability, control, and overall performance for the skier.

Figure 6:
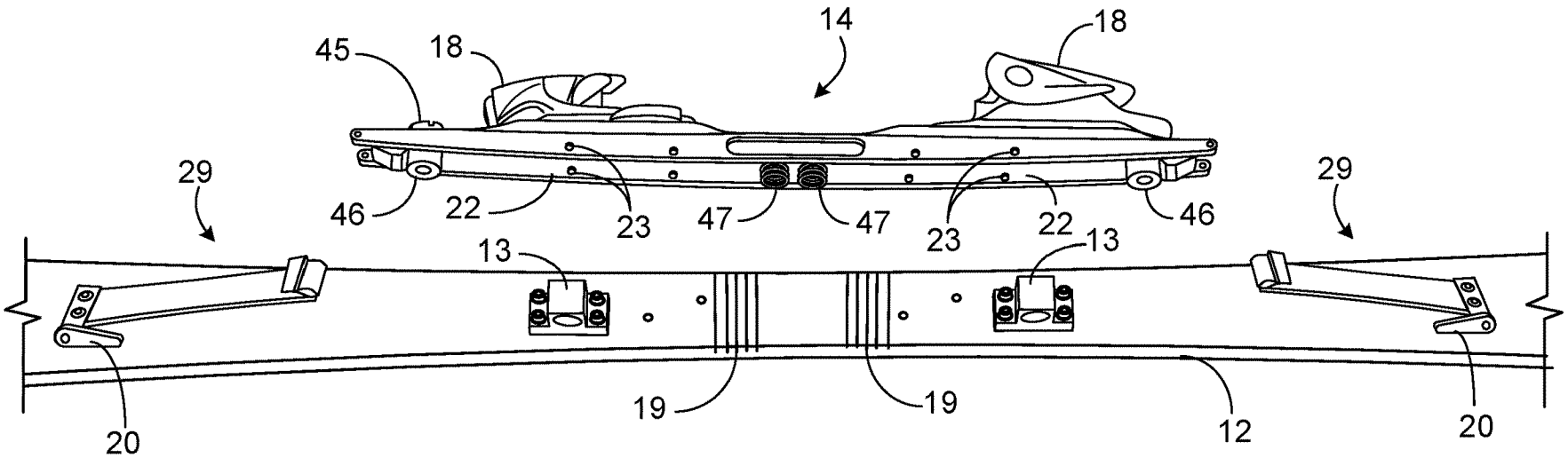
FIG. 6 shows an exploded view of an implementation of the adaptive ski described herein with key components indicated.
Figure 7:
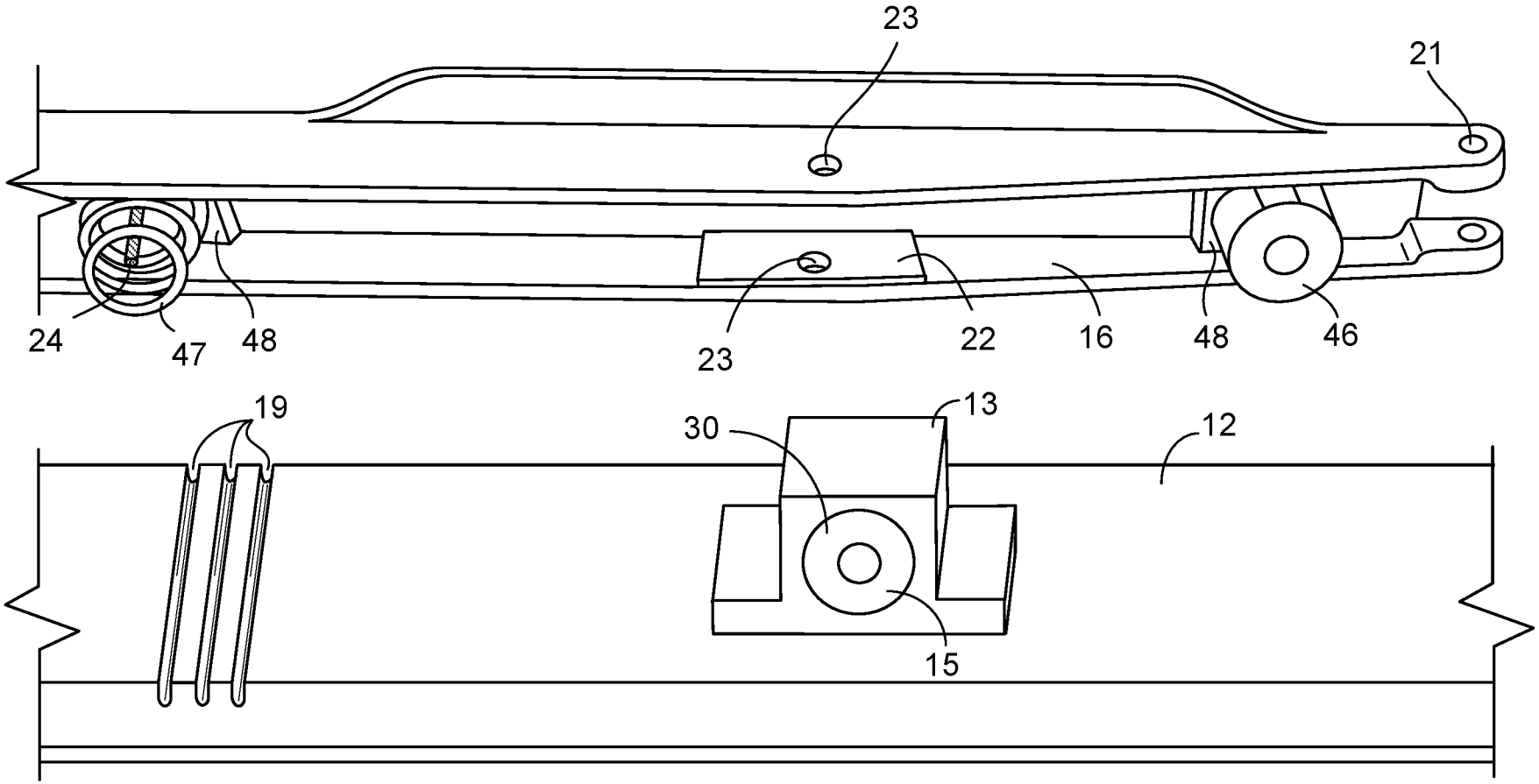
FIG. 7 shows a close-up view of the rear half of the central section of FIG. 6.

FIGS. 6 and 7 depict the suspension system 14 removed from the runner body 12 by removing the pins 25 and 17 (FIG. 5) leaving the spring assemblies 29 still pinned to the runner body 12 by way of the couplings 20. The support structure 16 is depicted with the toe and heel pieces 18 of a typical ski binding attached (FIG. 6). The support structure 16 is shown with the two central resilient elements 47 (although more or fewer resilient elements could be used), which as shown in this implementation are coil springs, but can be selected from the group consisting of coil springs, torsion springs, torsion bars, leaf springs, bow springs, elastomers, and pneumatic springs. The resilient elements 47 may also exhibit damping characteristics. With reference to FIG. 7, springs 47 are positioned by the threaded retainers 48, which are screwed onto threaded studs 24 that adjust the preload pressure of springs 47. The support structure 16 also comprises the resilient elements 46, which can be adjustable via threaded studs 24 that are threaded through the retainers 48 and attached to rings 45 (FIG. 6).

Figure 10:
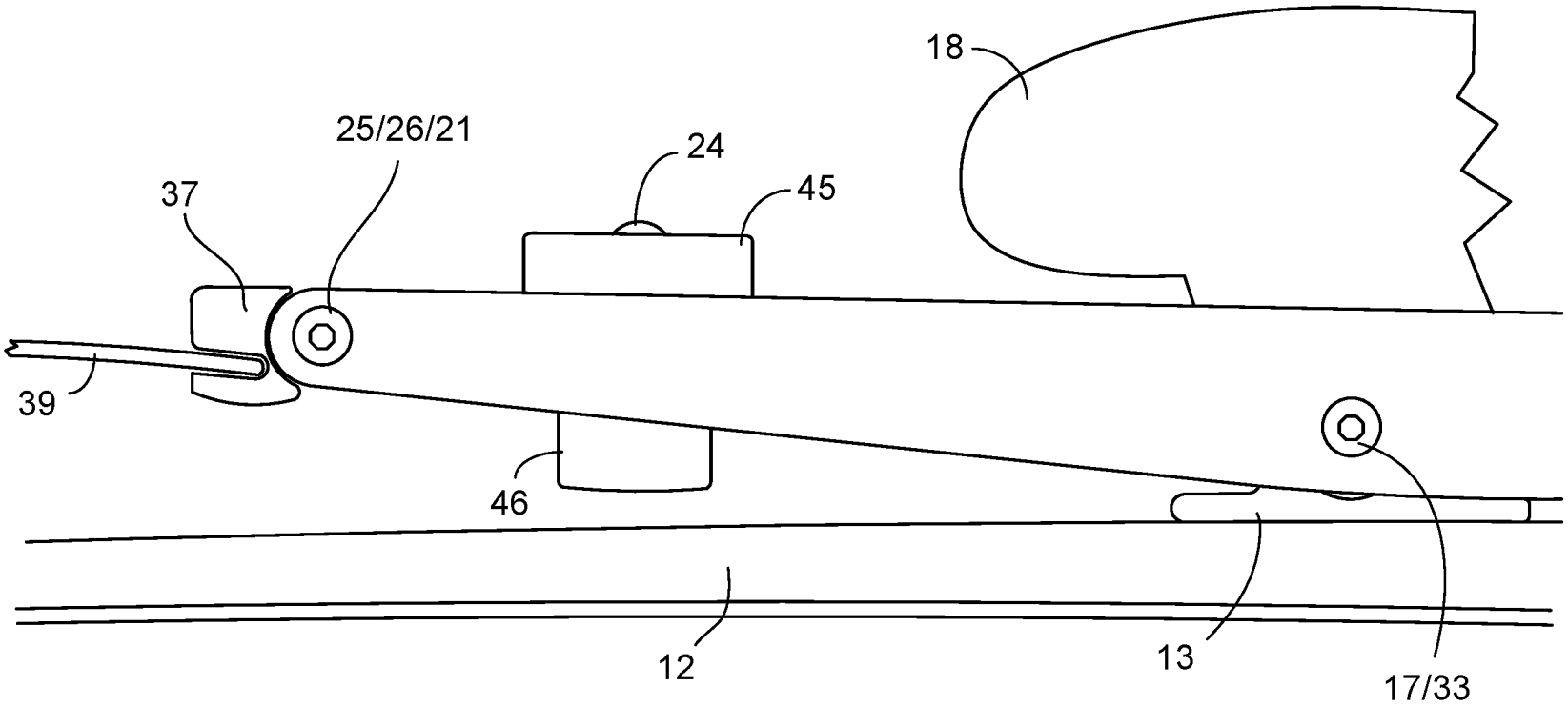
FIG. 10 shows a close-up side view of the forward part of the suspension system mounted to the runner.

The runner body 12 of this implementation shown in FIGS. 6 and 7 comprises two low flexural modulus regions 19 and mounting brackets 13, which comprise resilient elastomer elements 30 that include a lateral bore 15. The suspension assembly 14 is attached to the runner body 12 by positioning the support structure 16 over the mounting brackets 13 and passing pins 17 through both bores 23 in the support structure 16 and bores 15 in mounting brackets 13. These pins 17 are held in place by screws 33 (FIG. 10).

FIGS. 6 and 7 also show the contact region 119 formed and disposed between the two central flexible regions 19. The contact region 119 is designed to have a flexural modulus that is higher than the flexural modulus of the two central flexible regions 19. One or more resilient elements, for example one or more coil springs 47 along with their associated hardware, can engage the contact region 119 to exert an opposing force between the support structure 16 and the runner 12.

Figure 8:
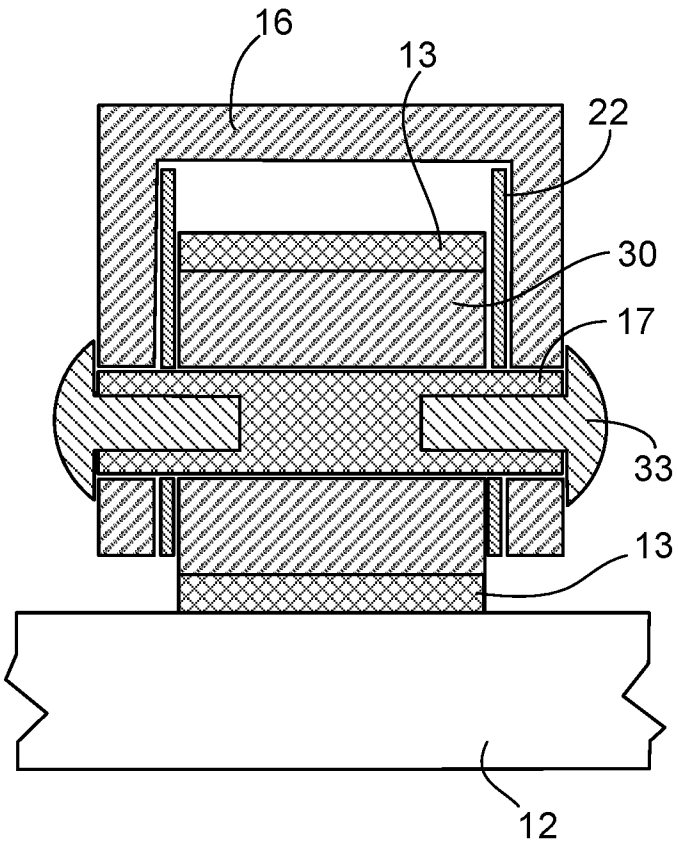
FIG. 8 shows a latitudinal cross section view cut through the center of one of the mounting brackets.

FIG. 8 is a latitudinal cross section through the center of one of the support brackets 13, depicting the close lateral side-to-side tolerance between the support structure 16 and the bracket 13, which precludes any yaw and roll motion between the two parts. A thin film of an ultra low friction bearing material 22 (for example UHMW polyethylene) separates the support structure 16 from the mounting bracket 13, which allows movement between the two in the vertical/longitudinal plane despite the close fit. While yaw and roll motion are precluded between the mounting bracket 13 and the support structure 16, the resilient couplings 30 allow the pins 17, and thus the support structure 16, some resilient and damped movement up/down and fore/aft (vertical/longitudinal plane). This resilient suspension of the support structure 16 over the ski body 12 allows the runner body to flex naturally and unimpeded during skiing as well as helping to isolate the skier from shocks and vibration. This movement also allows a slight rotation of the support structure 16 about the pitch axis relative to the ski body 12 when a skier becomes fore/aft imbalanced, which in turn alters the geometry of the suspension to create a greater down force on that portion of the ski body that would otherwise become light and unstable.

Figure 9:
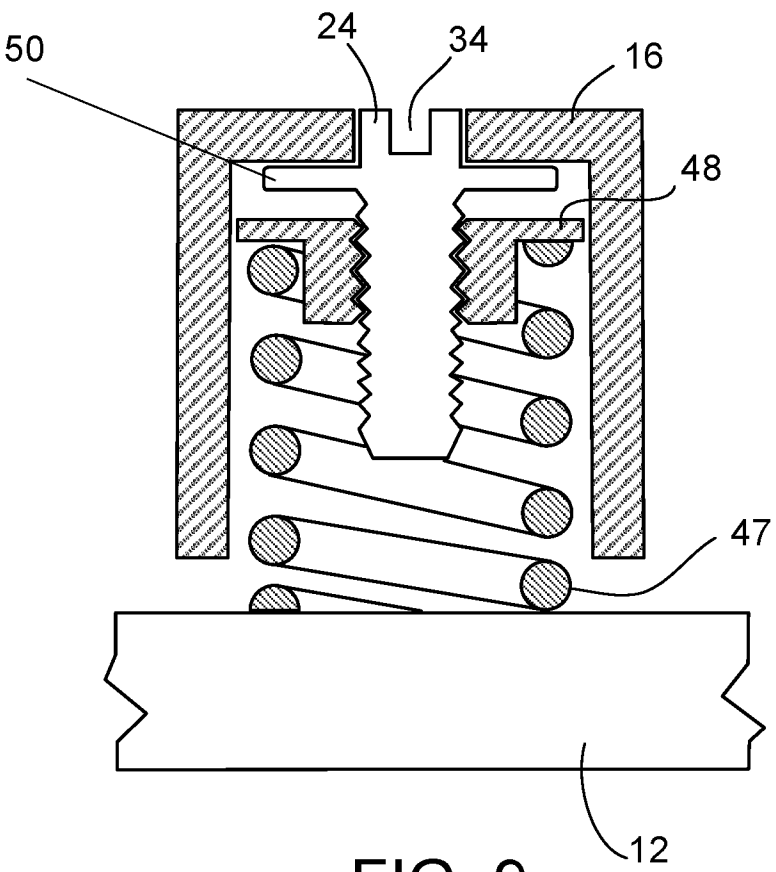
FIG. 9 shows a latitudinal cross section view cut through the center of one of the central resilient elements.

FIG. 9 is a latitudinal cross section through the center of one of the resilient elements 47 positioned in the central region of the support structure 16 between the two mounting brackets 13. The resilient element 47 in this depiction is a coil spring, which is held in position by a retainer 48 that is threaded onto a likewise threaded adjuster stud 24. The adjuster stud 24 has an integral flange 50 that transmits the upward vertical force of the spring 47 to the support structure 16. The adjuster stud 24 has a recess 34 at the top that accepts a tool that can turn it in either direction, which raises or lowers the retainer 48 thus increasing or decreasing the opposing force between the support structure 16 and the runner body 12 created by the spring 47.

FIG. 10 depicts the support structure 16 attached to the runner body 12 with pins 17 passed through the bores 23 in both the support structure 16 and mounting brackets 13 and held in place by screws 33. The vertical position of the resilient element 46 can be adjusted vertically up and down by turning the ring 45, which rotates the threaded stud 24. The outer circumference of ring 45 may include a knurled surface to provide additional grip when being turned in either direction. FIG. 10 also shows the details of the interconnection between the mounting boss 37 and the spring element 39, wherein the spring element 39 (shown here as a bow spring) is retained and bonded within a groove formed in the mounting boss 37.

Figure 11A:
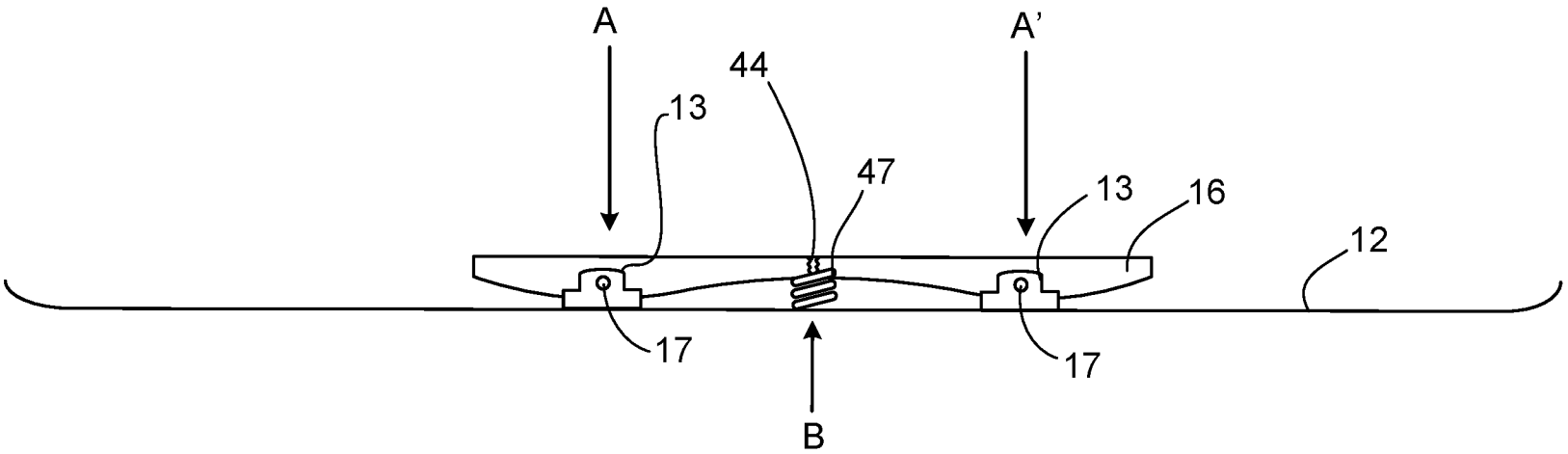
FIG. 11A shows a longitudinal side view depicting an implementation of the adaptive ski described herein as it would be automatically configured on flat hard snow.
Figure 11B:
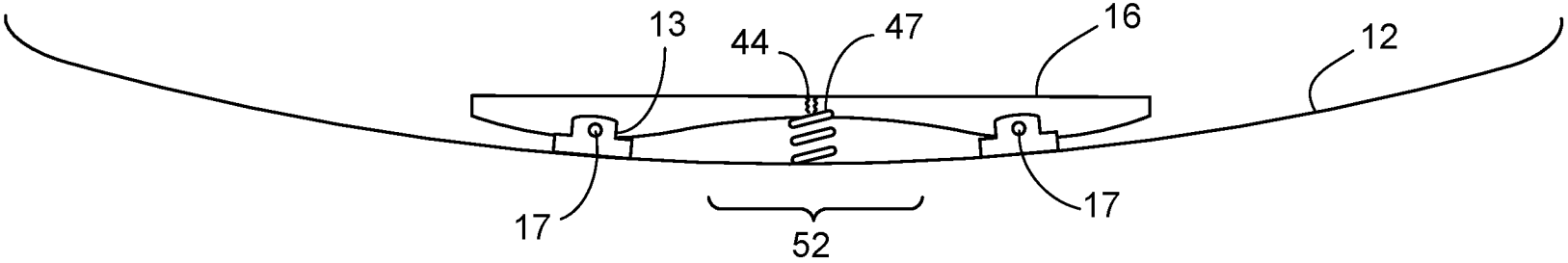
FIG. 11B shows a longitudinal side view depicting an implementation of the adaptive ski described herein as it would be automatically configured in powder or soft snow.

FIGS. 11A and 11B illustrate the unique functionality of the adaptive ski. FIG. 11A depicts the adaptive ski on hard or firm snow that is typical of groomed ski slopes. The skier's weight is applied to the support structure 16, which transmits that pressure to the runner 12 via the pins 17 and mounting brackets 13. These pressure points created by the skier's weight are indicated in FIG. 11A by the arrows A and A'. The skier's weight pushing down at A and A' will compress the central spring 47 against the firm snow under the runner, indicated by the arrow B. As the spring 47 compresses, the central section of the runner 12 that was previously convex on soft or powder snow (see FIG. 11B) pivots upward on the pins 17 in the mounting brackets 13 until the runner 12 at points A and A' are also on the firm flat snow. This upward pivoting of the central section of the runner 12 upon the pins 17 in mounting brackets 13, which act as effective fulcrums at A and A', causes the tip and tail of the runner 12 to conversely pivot in the opposite direction, bringing them downward to engage the firm snow. This is the ideal configuration for a ski in firm snow conditions because a longer length of the ski and ski edge engage and make contact with the snow surface. The pressure from the spring 47, which is immediately under the skier's boot, creates a small region of high pressure that causes the steel edge of the runner 12 to easily penetrate the firm snow providing unprecedented control and stability. Likewise, the tip and tail are held firmly against the firm snow by the moment forces created by the skier's downward weight at A and A' against the firm snow at B. Thus, on firm snow, the adaptive ski transforms into the ideal groomed-snow carving ski.

When the adaptive ski encounters soft snow or powder, there is no longer firm snow under the runner at B and the spring 47 expands against the center section of the runner 12, pivoting the center section downward on the pins 17 in the mounting brackets 13 as depicted in FIG. 11B. This causes the tip and tail to pivot upwards thus creating the ideal convex or rocker configuration that is ideal for soft snow or powder.

When the runner 12 comprises the previously described flexible center area 52, this unique functionality, depicted in FIGS. 11A & 11B, is significantly enhanced.

This novel functionality represents the first ever alpine ski that will automatically transform into an ideal powder ski in powder and an ideal carving ski on firm groomed slopes.

Figure 12A:
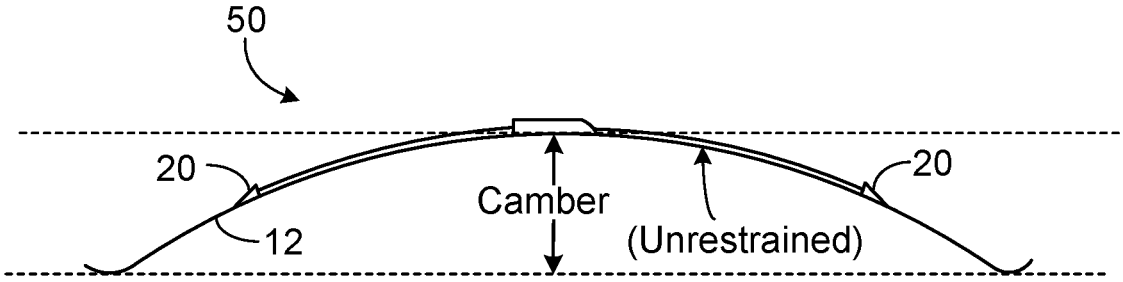
FIGS. 12A, B, C show longitudinal side views depicting various configurations of implementations of the adaptive ski described herein.
Figure 12B:
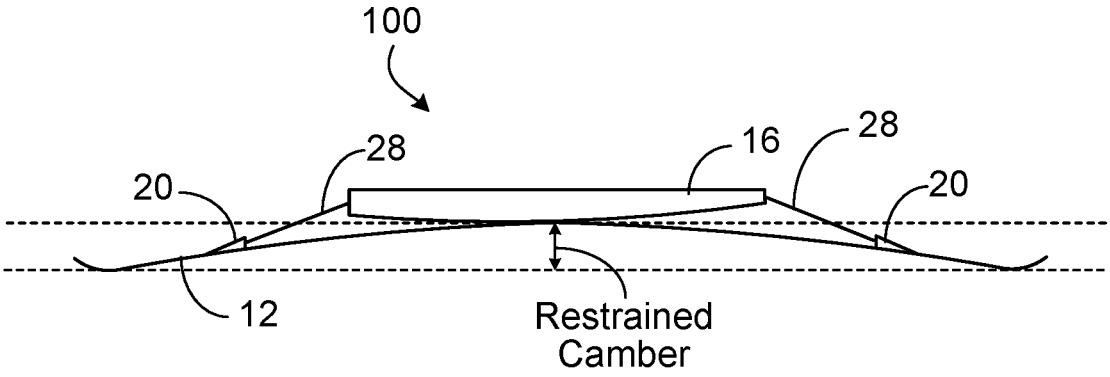
Figure 12C:
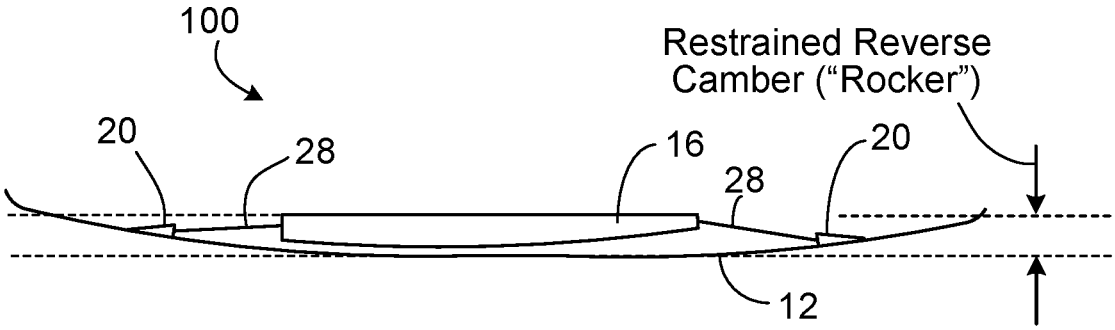

FIGS. 12A, 12B, and 12C depict an alternate implementation of the ski depicted in FIG. 5, which differs from that of FIG. 5 in two significant details. Firstly, the runner 12 in this implementation is fabricated with intrinsic camber as depicted in FIG. 12A (the camber in FIG. 12A is exaggerated for clarity). Secondly, as illustrated in FIG. 12B, the compressive spring elements 39 shown in FIG. 5 are replaced by tension elements 28 that connect the ends of the support structure 16 or elements within the support structure 16 with couplers 20 attached to the tip and tail sections of the runner 12. These tension elements 28, which can be solid linkages or flexible cables, pull the tip and tail sections of the runner 12 upward, thus reducing the intrinsic camber of the runner 12 as depicted in FIG. 12B. The tension elements 28 can be further shortened to pull the tip and tail of the runner 12 into a rocker configuration as depicted in FIG. 12C. Additionally, the length of the tension elements 28 can be adjustable, and thus a wide range from camber to rocker can be created allowing the ski to be fine-tuned to particular conditions. This configuration also creates a high compliance preload on the tip and tail similar to that of the implementation of FIG. 5, which provides great stability in all conditions as well as mitigating sudden forces at the tip or tail that could imbalance a skier.

Figure 13A:
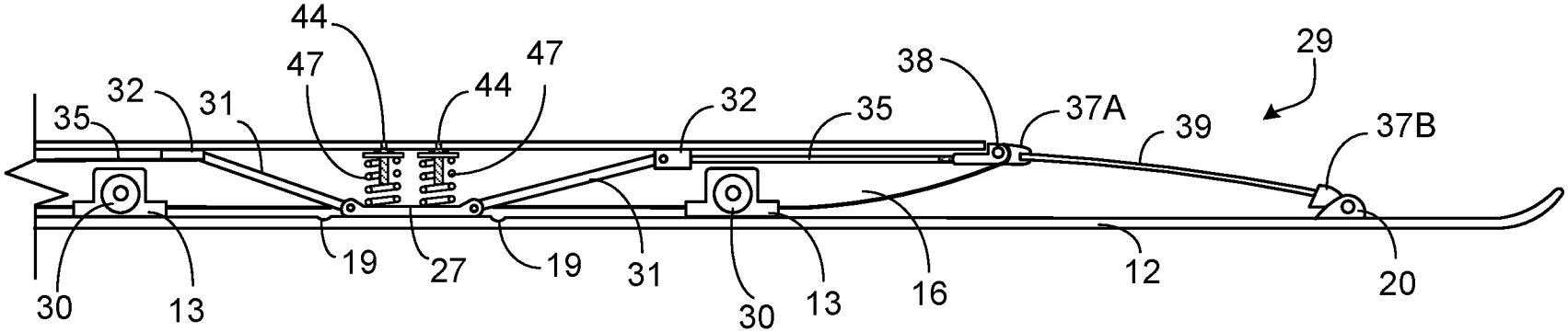
FIGS. 13A, B show longitudinal side views depicting another implementation of the adaptive ski described herein.
Figure 13B:
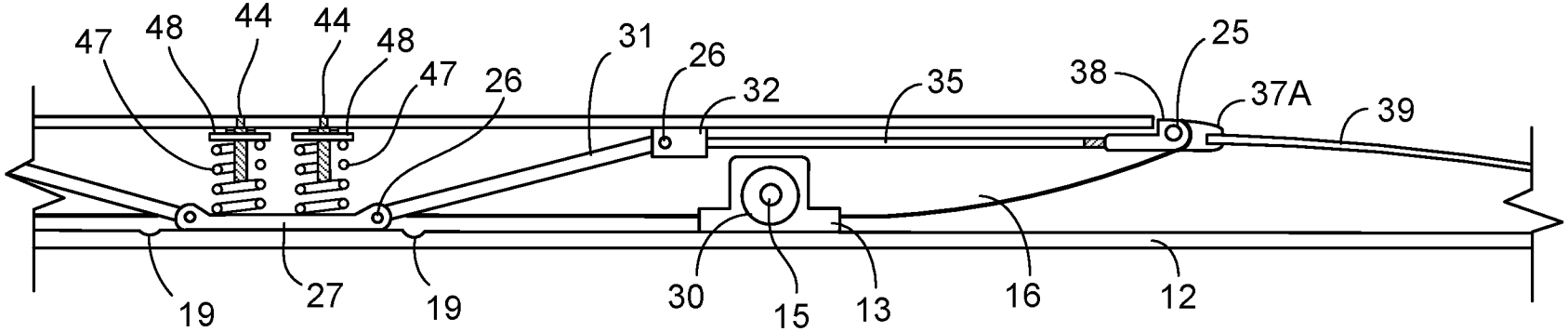

FIGS. 13A and 13B illustrate an implementation of the adaptive ski shown in FIGS. 5 thru 11 that comprises an additional mechanism that enhances the previously described functionality. In this implementation, the tip and tail compressive spring assemblies 29 are not pinned directly to the support structure 16 but pinned 25 to hinge blocks 38 that can slide longitudinally in the ends of the support structure 16. The sliding hinge blocks 38 are connected to additional sliding hinge blocks 32 by linkages 35. The linkages 35 may be threaded into the hinge blocks 38 and/or 32, thus providing adjustment of the pressure and vertical position of the tip and tail sections of the runner 12 when the ski is unweighted and not pressured against the snow. The sliding hinge blocks 32 are pinned to one end of linkages 31, the other end of linkages 31 being pinned 26 to the hinge plate 27 that is attached to or positioned on the runner 12 between the flexible hinge regions 19 of the runner and under the central springs 47.

The functionality of this implementation is conceptually identical to that depicted and described by FIGS. 11A and 11B with the added benefit of enhanced tip and tail adjustment and control. When the runner 12 is on firm or hard snow as in FIG. 11A, the springs 47 are compressed and the tip and tail of the runner 12 will be forced downward as previously described. However in this implementation, the compression of springs 47 results in the hinge plate 27 rising vertically relative to the support structure 16 thus forcing, via the respective linkages 31, the sliding hinge blocks 32 to slide longitudinally toward the respective ends of the support structure 16. This in turn, via the linkages 35, pushes the respective sliding hinge blocks 38 longitudinally outward relative to the support structure 16. This in turn forces the mounting hinge bosses 37A of the spring assembly 29 outward toward the tip and tail respectively resulting in the spring assembly 29, and thus compressive resilient elements 39, pushing the tip and tail further downward onto the snow with increased force. Thus, in firm or hard snow, the linkage described in this implementation will provide additional tip and tail stability and control.

Conversely, when the runner 12 encounters soft snow or powder, the springs 47 will expand as illustrated and explained in FIG. 11B, causing the tip and tail to bend upward into a rocker configuration ideal for those conditions. However in this implementation, the expansion of springs 47 results in the hinge plate 27 moving vertically away from the support structure 16 thus pulling, via the respective linkages 31, the sliding hinge blocks 32 longitudinally toward the center of the support structure 16. This in turn, via the linkages 35, pulls the respective sliding hinge blocks 38 longitudinally inward toward the center of the support structure 16. This in turn pulls the mounting hinge bosses 37A of the spring assembly 29 inward toward the support structure 16 resulting in the spring assembly 29, and thus compressive resilient elements 39, pulling the tip and tail further upward into a more extreme rocker configuration. Thus, on firm groomed snow, this implementation has the enhanced tip and tail contact with the snow provided by the spring assemblies 29, resulting in extraordinary control and stability. And in soft snow and powder it will still automatically assume the rockered configuration that is best suited for those conditions. Additionally, the adaptive ski exhibits extraordinary torsional rigidity and instantaneous responsiveness due to the fact that roll input from the skier's boot is transmitted directly to the tip and tail of the runner by the spring assemblies 29 as well as by the mounting brackets 13, which are located at the stiffest regions of the runner 12.

Additionally, this implementation can be combined with the implementation depicted in FIGS. 12A, B, & C, in which case the compressive resilient elements 39 in FIGS. 13 A & B are replaced by tension elements 28 (depicted in FIG. 12C) that connect the sliding hinge blocks 38 in FIGS. 13A & 13B at the ends of the support structure 16 with couplers 20 attached to the tip and tail sections of the runner 12. These tension elements 28, which can be solid linkages or flexible cables, pull the tip and tail sections of the runner upward, reducing the intrinsic camber of the runner 12 as depicted in FIG. 12B, or upward into a rocker configuration as depicted in FIG. 12C.

When the runner 12 encounters soft snow or powder, the springs 47 will expand as illustrated and explained in FIG. 11B, causing the tip and tail to bend upward which is ideal for those conditions. However in this implementation, the expansion of springs 47 results in the hinge plate 27 moving vertically away from the support structure 16 thus pulling, via the respective linkages 31, the sliding hinge blocks 32 longitudinally toward the center of the support structure 16. This in turn, via the linkages 35, pulls the respective sliding hinge blocks 38 longitudinally inward toward the center of the support structure 16. This in turn pulls the mounting hinge bosses 37A and the tension element 28 inward toward the support structure 16 resulting in the tension elements 28 pulling the tip and tail further upward into a more extreme rocker configuration.

Conversely, when the runner 12 is on firm or hard snow as in FIG. 11A, the springs 47 are compressed and the tip and tail of the runner 12 will be forced downward as previously described. However in this implementation, the compression of springs 47 results in the hinge plate 27 rising vertically relative to the support structure 16 thus forcing, via the respective linkages 31, the sliding hinge blocks 32 to slide longitudinally toward the respective ends of the support structure 16. This in turn, via the linkages 35, pushes the respective sliding hinge blocks 38 longitudinally outward relative to the support structure 16. This in turn forces the mounting hinge bosses 37A and the respective ends of the tension elements 28 outward toward the tip and tail respectively resulting in the tension forces being substantially precluded from tension elements 28 allowing the tip and tail to bend further downward onto the snow. Thus, in firm or hard snow, this implementation will provide additional tip and tail stability and control.

Figure 14A:
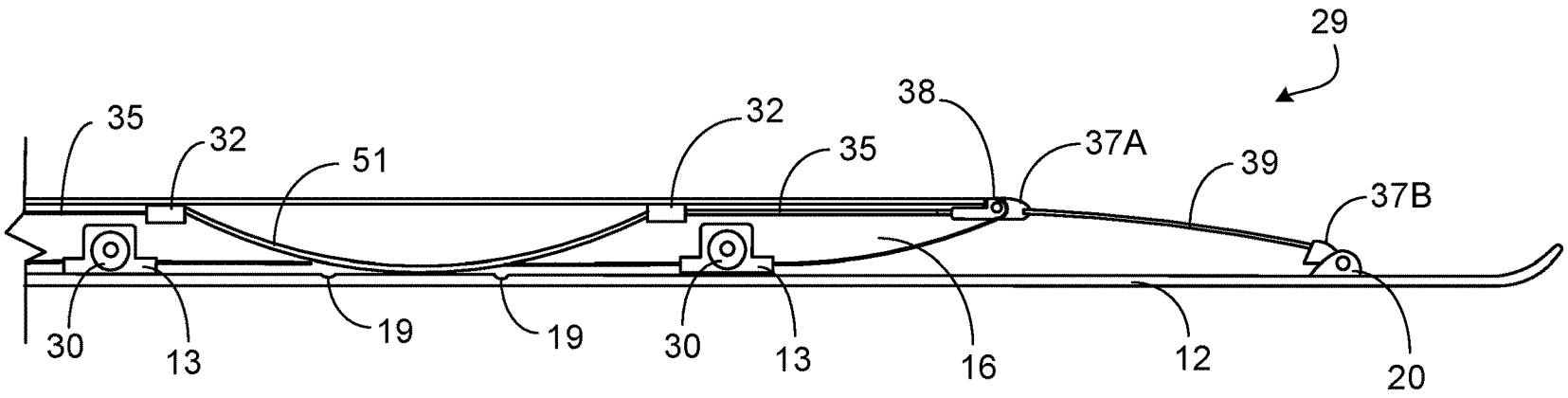
FIGS. 14 A, B show longitudinal side views depicting another implementation of the adaptive ski described herein.
Figure 14B:
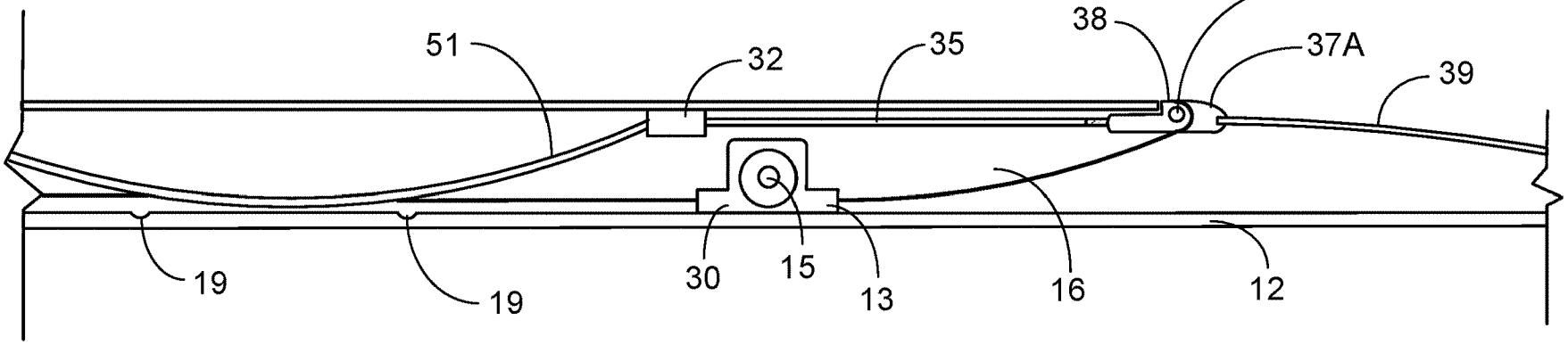

FIGS. 14A and 14B illustrate an implementation of the adaptive ski shown in FIGS. 13A and 13B wherein the coil spring resilient elements 47 and the related components 27, 31, 44, and 48 are replaced with a bow spring or leaf spring 51. The functionality of this implementation is identical to that described for the implementation depicted in FIGS. 13A and 13B. As the bow spring 51 is compressed, the extremities will move longitudinally toward the respective ends of the support structure 16, which will force the sliding hinge blocks 32 to slide longitudinally toward the respective ends of the support structure 16. This in turn, via the linkages 35, pushes the respective sliding hinge blocks 38 longitudinally outward relative to the support structure 16. This in turn forces the mounting hinge bosses 37A of the spring assembly 29 outward toward the tip and tail respectively resulting in the spring assembly 29, and thus compressive resilient elements 39, pushing the tip and tail downward onto the snow with increased force. Thus in firm or hard snow, this implementation will provide additional tip and tail stability and control.

Conversely, when the bow spring 51 expands vertically, the extremities will move longitudinally inward toward the center of the support structure 16, causing the sliding hinge blocks 32 to also move longitudinally toward the center of the support structure 16. This in turn, via the linkages 35, pulls the respective sliding hinge blocks 38 longitudinally inward toward the center of the support structure 16. This in turn pulls the mounting hinge bosses 37A of the spring assembly 29 inward toward the support structure 16 resulting in the spring assembly 29, and thus compressive resilient elements 39, pulling the tip and tail further upward into a more extreme rocker configuration, ideal for powder conditions.

It is understood that this invention is not confined to the particular implementations shown and described herein, the same being merely illustrative, and that this invention may be carried out in other ways within the scope of the appended claims without departing from the spirit of the invention as it is understood by those skilled in the art that the particular implementations shown and described are only a few of the many that may be employed to attain the express and implied objects of the invention.

What is claimed is:

1. A ski for use on ice or snow comprising:

a ski body comprising a tip portion, a tail portion, and a longitudinal running length extending between the tip portion and the tail portion and a substantially flat bottom surface for sliding on snow or ice;

a suspension system comprised of a substantially rigid support structure secured to a longitudinally central region of the ski body at two attachment locations;

at least one spring element configured to exert an opposing force between the support structure and the ski body in an area between the two attachment locations; and a linkage structure configured to impart an essentially longitudinal force between the central region of the ski body and the tip and/or tail portion of the ski body, the linkage structure having a first end connected to the central region of the ski body, a second end connected to the tip and/or tail of the ski body, wherein the linkage structure comprises a compressible resilient element.

2. The ski of claim 1 further comprising stiffening elements that increase a longitudinal flexural modulus of the ski body at the attachment locations where the support structure is secured to the ski body such that a resulting longitudinal flexural modulus of the ski at the attachment locations is greater than the longitudinal flexural modulus of the ski body in a region between the two attachment locations.

3. The ski of claim 1 wherein the ski body exhibits a lower longitudinal flexural modulus in the central longitudinal region between the two attachment locations relative to the longitudinal flexural modulus of the ski body at the two attachment locations.

4. The ski of claim 1 wherein the compressible resilient element comprises a damping element.

5. The ski of claim 1 wherein the compressible resilient element is preloaded so that the compressible resilient element will not compress until the compressive force exceeds a specific threshold, and, prior to the specific threshold force being exceeded, elongation or expansion of the preloaded compressible resilient element is precluded.

6. The ski of claim 1 wherein compression of the spring element that is configured to exert an opposing force between the support structure and the ski body between the two attachment locations, increase the force that a forward linkage structure applies to a forward quarter of the running length of the ski body and/or that an aft linkage structure applies to a rear quarter of the running length of the ski body, respectively causing the tip and/or tail of the ski body to bend downward, increasing camber and/or increasing downward pressure.

7. The ski of claim 1 wherein the expansion of the spring element that is configured to exert an opposing force between the support structure and the ski body between the two attachment locations, decreases the force that a forward linkage structure applies to a forward quarter of the running length of the ski body and/or that an aft linkage structure applies to a rear quarter of the running length of the ski body, respectively causing the tip and/or tail of the ski body to bend upward, increasing rocker and decreasing camber.

8. The ski of claim 1 wherein the compressible resilient element is selected from the group consisting of coil springs, torsion springs, torsion bars, leaf springs bow springs, pneumatic springs, and elastomers.

9. The ski of claim 1 wherein the spring element configured to exert an opposing force between the support structure and the ski body in the area between the two attachment locations is adjustable and the opposing force can be increased and decreased.

10. The ski of claim 1 wherein the linkage structure configured to impart a longitudinal force to the tip and/or tail region of the ski body, is adjustable to increase or decrease the natural camber or rocker of the ski body.

11. The ski of claim 1 wherein at a predetermined degree of deflection, the ski body will exhibit a spring rate at least 25% less than a maximum spring rate exhibited by the ski prior to the predetermined degree of deflection.

12. The ski of claim 1 wherein the ski body is constructed with intrinsic positive camber, and the essentially longitudinal force that the linkage structure is configured to impart between the central longitudinal region of the ski body and the tip and/or tail region of the ski body is a tensive force such that the tensive force reduces the natural camber of the ski body.

13. The ski of claim 12, wherein compression of the spring element that is configured to exert an opposing force between the support structure and the ski body between the two attachment locations, decreases the tensive force that the linkage structure applies to the tip and/or tail region of the ski body causing the tip and/or tail respectively to exhibit greater downward force and greater maximum camber.

14. The ski of claim 12 wherein expansion of the spring element that is configured to exert an opposing force between the support structure and the ski body between the two attachment locations, increases the tensive force that the linkage structure applies to the tip and/or tail region of the ski body causing the tip and/or tail respectively to exhibit less/reduced downward force and reduced maximum camber or increased rocker.

15. The ski of claim 12 wherein the linkage structure is adjustable to increase or decrease the natural camber or rocker of the ski body.

16. The ski of claim 12 wherein at a predetermined degree of deflection, the ski body will exhibit a spring rate at least 25% less than a maximum spring rate exhibited by the ski prior to the predetermined degree of deflection.

17. The ski of claim 12 wherein the spring element configured to exert an opposing force between the support structure and the ski body in the area between the two attachment locations is adjustable and the opposing force can be increased and decreased.

18. A ski for use on ice or snow comprising:

a ski body comprising a tip portion, a tail portion, and a longitudinal running length extending between the tip portion and the tail portion and a substantially flat bottom surface for sliding on snow or ice;

a suspension system comprised of a substantially rigid support structure secured to a longitudinally central region of the ski body at two attachment locations;

at least one spring element configured to exert an opposing force between the support structure and the ski body in an area between the two attachment locations; and a linkage structure configured to impart an essentially longitudinal force between the tip/front portion of the ski body and the tail/rear portion of the ski body, the linkage structure having a first end connected to the tip/front portion of the ski body, and a second end connected to the tail/rear portion of the ski body, wherein the linkage structure comprises a compressible resilient element.

19. The ski of claim 18 further comprising stiffening elements that increase a longitudinal flexural modulus of the ski body at the attachment locations where the support structure is secured to the ski body such that a resulting longitudinal flexural modulus of the ski at the attachment locations is greater than the longitudinal flexural modulus of the ski body in a region between the two attachment locations.

20. The ski of claim 18 wherein the ski body exhibits a lower longitudinal flexural modulus in the central longitudinal region between the two attachment locations relative to the longitudinal flexural modulus of the ski body at the two attachment locations.

21. The ski of claim 18 wherein the compressible resilient element comprises a damping element.

22. The ski of claim 18 wherein the compressible resilient element is preloaded so that the compressible resilient element will not compress until the compressive force exceeds a specific threshold, and, prior to the specific threshold force being exceeded, elongation or expansion of the preloaded compressible resilient element is precluded.

23. The ski of claim 18 wherein compression of the spring element that is configured to exert an opposing force between the support structure and the ski body between the two attachment locations, increases the force that the linkage structure applies to a forward quarter of the running length of the ski body and to a rear quarter of the running length of the ski body, causing the tip and tail of the ski body to bend downward, increasing camber and/or increasing downward pressure.

24. The ski of claim 18 wherein expansion of the spring element that is configured to exert an opposing force between the support structure and the ski body between the two attachment locations, decreases the force that the linkage structure applies to a forward quarter of the running length of the ski body and a rear quarter of the running length of the ski body, causing the tip and tail of the ski body to bend upward, increasing rocker and decreasing camber and downward pressure.

25. The ski of claim 18 wherein the compressible resilient element is selected from the group consisting of coil springs, torsion springs, torsion bars, leaf springs bow springs, pneumatic springs, and elastomers.

26. The ski of claim 18 wherein the spring element configured to exert an opposing force between the support structure and the ski body in the area between the two attachment locations is adjustable and the opposing force can be increased and decreased.

27. The ski of claims 18 wherein the linkage structure configured to impart a longitudinal force to the tip and tail region of the ski body, is adjustable to increase or decrease the natural camber or rocker of the ski body.

28. The ski of claim 18 wherein at a predetermined degree of deflection, the ski body will exhibit a spring rate at least 25% less than a maximum spring rate exhibited by the ski prior to the predetermined degree of deflection.

29. A ski for use on ice or snow comprising:

a ski body comprising a tip portion, a tail portion, and a longitudinal running length extending between the tip portion and the tail portion and a substantially flat bottom surface for sliding on snow or ice;

a suspension system comprised of a substantially rigid support structure secured to a longitudinally central region of the ski body at two attachment locations;

at least one spring element configured to exert an opposing force between the support structure and the ski body in an area between the two attachment locations; and a linkage structure configured to impart an essentially longitudinal force between the tip/front portion of the ski body and the tail/rear portion of the ski body, the linkage structure having a first end connected to the tip/front portion of the ski body, and a second end connected to the tail/rear portion of the ski body, wherein the ski body is constructed with intrinsic positive camber, and the essentially longitudinal force that the linkage structure is configured to impart between the tip/front region of the ski body and the tail/rear tail region of the ski body is a tensive force such that the tensive force reduces the natural camber of the ski body.

30. The ski of claim 29 wherein compression of the spring element that is configured to exert an opposing force between the support structure and the ski body between the two attachment locations, decreases the tensive force that the linkage structure applies to the tip and tail region of the ski body causing the tip and tail to exhibit greater downward force and greater maximum camber.

31. The ski of claim 29 wherein expansion of the spring element that is configured to exert an opposing force between the support structure and the ski body between the two attachment locations, increases the tensive force that the linkage structure applies to the tip and tail region of the ski body causing the tip and tail to exhibit less/reduced downward force and reduced maximum camber or increased rocker.

32. The ski of claim 29 wherein the linkage structure is adjustable to increase or decrease the natural camber or rocker of the ski body.

33. The ski of claim 29 wherein at a predetermined degree of deflection, the ski body will exhibit a spring rate at least 25% less than a maximum spring rate exhibited by the ski prior to the predetermined degree of deflection.

34. The ski of claim 29 wherein the spring element configured to exert an opposing force between the support structure and the ski body in the area between the two attachment locations is adjustable and the opposing force can be increased and decreased.

* * * * *